US012454884B2

(12) United States Patent
Reilly et al.

(10) Patent No.: US 12,454,884 B2
(45) Date of Patent: Oct. 28, 2025

(54) DOWNHOLE TOOL ASSEMBLIES

(71) Applicant: REFLEX INSTRUMENTS ASIA PACIFIC PTY LTD, Balcatta (AU)

(72) Inventors: James Barry Reilly, Balcatta (AU); Nicholas Coplin, Balcatta (AU); Amir Mokaramian, Balcatta (AU); Marian Javorka, Balcatta (AU)

(73) Assignee: REFLEX INSTRUMENTS ASIA PACIFIC PTY LTD, Balcatta (AU)

( * ) Notice: Subject to any disclaimer, the term of this patent is extended or adjusted under 35 U.S.C. 154(b) by 0 days.

(21) Appl. No.: 18/291,960

(22) PCT Filed: Jul. 19, 2022

(86) PCT No.: PCT/AU2022/050762

§ 371 (c)(1),
(2) Date: Jan. 25, 2024

(87) PCT Pub. No.: WO2023/004452

PCT Pub. Date: Feb. 2, 2023

(65) Prior Publication Data

US 2025/0020051 A1 Jan. 16, 2025

(30) Foreign Application Priority Data

Jul. 29, 2021 (AU) ..... 2021209301

(51) Int. Cl.
*E21B 47/017* (2012.01)

(52) U.S. Cl.
CPC ..... *E21B 47/017* (2020.05)

(58) Field of Classification Search
CPC ..... E21B 47/017; E21B 25/02; E21B 25/005; E21B 25/04; E21B 47/01; E21B 49/02
See application file for complete search history.

(56) References Cited

U.S. PATENT DOCUMENTS 2,652,232 A 9/1953 Holland, Jr.
3,120,282 A 2/1964 Pickard
(Continued)

FOREIGN PATENT DOCUMENTS

AU 1218676 A 8/1997
JP 2010174466 A 8/2010
(Continued)

OTHER PUBLICATIONS

Australian Patent Office, Written Opinion issued in corresponding Application No. PCT/AU2022/050762, mailed Jun. 22, 2023.

*Primary Examiner* — Yanick A Akaragwe
(74) *Attorney, Agent, or Firm* — Stites & Harbison, PLLC; Terry L. Wright

(57) ABSTRACT

Downhole tool assembly (10) for mounting to a core barrel assembly (12) including a core tube (14) and a pair of split tubes (16). The downhole tool assembly (10) includes a downhole tool (18) and at least one sleeve (20) dimensioned to slidingly engage the split tubes (16) to inhibit radial movement of the split tubes (16) and receive and retain the downhole tool (18) coaxially with the core tube (14). Core ejection pistons (72), and methods for extracting a core from bedrock are also disclosed. A housing assembly (120) for a downhole tool, downhole assemblies (180, 200), and methods of assembling such assemblies are also disclosed.

23 Claims, 12 Drawing Sheets

(56) References Cited

U.S. PATENT DOCUMENTS

| | | | | |
|---|---|---|---|---|
| 4,466,495 | A | 8/1984 | Jageler | |
| 6,173,795 | B1 * | 1/2001 | McGarian | E21B 23/006 166/321 |
| 2018/0252071 | A1 * | 9/2018 | Beach | E21B 25/02 |

FOREIGN PATENT DOCUMENTS

| | | | |
|---|---|---|---|
| WO | 9508694 | A1 | 3/1995 |
| WO | 2010091471 | A1 | 8/2010 |
| WO | 2016205927 | A | 12/2016 |
| WO | 2021050844 | A1 | 3/2021 |

* cited by examiner

DOWNHOLE TOOL ASSEMBLIES

CROSS-REFERENCE TO RELATED APPLICATIONS

This application claims priority to Australian provisional patent application no. 2021209301, filed 29 Jul. 2021, the content of which is incorporated herein in its entirety.

TECHNICAL FIELD

The present disclosure relates, generally, to downhole assemblies used as part of a drilling rig operable to extract a core and, particularly, to assemblies including a downhole tool and configured to couple to a core barrel assembly for receiving drilled core.

BACKGROUND

Core extraction allows analysis of underground rock formations by geologists. A core is typically extracted by operating a drilling rig mounted at surface level. The core is drilled from the bedrock and received within a core barrel, also known as an inner tube or core tube. A downhole tool (or alternatively, a downhole sensor or instrument) is usually threadedly engaged with an upstream end of the core barrel such that the tool extends axially away from the core barrel to be interposed between the core barrel and a back-end assembly. The tool is typically operated concurrently with drilling, to allow measuring various parameters, such as orientation of the core when broken from the bedrock. After drilling the core, the core barrel, containing the core, and tool is retrieved to the surface, the core and tool removed for analysis, and another or the same core barrel attached to the same or another tool and redeployed into the borehole to allow drilling and receiving another core. Boreholes are often 1 km or more deep, and typically filled with water and/or drilling fluid or mud, meaning that the descent time for the core barrel to reach the drill bit can be significant.

Core barrels typically form part of an assembly and are configured to allow receiving a specifically dimensioned core. Core barrel assemblies are often dimensioned according to standardised sizes to allow obtaining standardised cores. The assembly sizing label typically relates to the core diameter which the assembly is configured to receive, common industry standard sizes including BQ™, NQ™, HQ™ and PQ™. It will be appreciated that various standardised sizes exist, and that the "Q" sizes described above are one example of a standard defined by Boart Longyear.

Commonly, a core barrel assembly comprises an outer drilling barrel or tube which is rotationally coupled to the drill bit, and an inner tube arranged within the outer barrel/tube to be de-coupled from the drill bit and arranged to receive the drilled core. The inner tube is axially movable relative to the outer tube to allow retrieving to the surface. Some core barrel assemblies comprise the outer tube, the inner tube, and a pair of split tubes housed within the inner tube and arranged to receive a specifically dimensioned core—known as a "triple tube core barrel". Each split tube is shaped to define half of a cylindrical tube split along a longitudinal axis.

Removing a core from a triple-tube core barrel assembly at surface level typically involves disconnecting the downhole tool from the core barrel assembly, sealingly engaging a plug across the inner tube, typically by engaging an ejection piston arranged within the inner tube, and pumping fluid into the inner tube and against the plug. This causes the plug and/or piston to urge against and push the split tubes and core out of the core barrel. Fitting the plug can prove difficult as the piston and/or inner tube may be covered in mud and/or other debris which can inhibit engaging the plug within the inner tube.

Any discussion of documents, acts, materials, devices, articles or the like which has been included in the present specification is not to be taken as an admission that any or all of these matters were common general knowledge in the field relevant to the present disclosure as it existed before the priority date of each of the appended claims.

SUMMARY

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

According to one aspect of the disclosure, there is provided a downhole tool assembly for mounting to a core barrel assembly, the core barrel assembly including a core tube defining a bore and a pair of split tubes arranged within the core tube and adjacent to each other to surround the bore. The downhole tool assembly includes a downhole tool, and at least one sleeve dimensioned to slidingly engage the split tubes to inhibit radial movement of the split tubes relative to the bore, and shaped to receive and retain the downhole tool coaxially with the bore.

The assembly may include a pair of the sleeves, where a first sleeve is configured to receive and engage an end of the downhole tool, and a second sleeve is configured to be arranged partway along and engage the downhole tool.

The first sleeve may define a conical end configured to be arranged to face downhole within the bore.

The, or each, sleeve may be shaped to allow fluid flow along the bore and past the sleeve.

The assembly may also include a retaining portion configured to be arranged against an uphole end of each split tube to inhibit axial movement of the split tubes relative to the bore. In some embodiment, the retaining portion may be integrally formed with the at least one sleeve.

The, or each, sleeve may define a cavity for receiving the downhole tool, and the assembly may also include at least one retainer ring configured to receive and engage the downhole tool and slidingly engage the cavity of the, or each, sleeve.

The assembly may also include a tool coupling configured to receive and retain the downhole tool, and threadedly engage the core tube.

According to another aspect of the disclosure, there is provided a core ejection piston for mounting within a core tube. The core ejection piston includes a body dimensioned to slidingly engage the core tube. The body has a downhole end and an opposed uphole end, and a cavity extending between the ends to define an axis. The cavity is configured to receive a downhole tool. The body also defines at least one bypass channel arranged to allow fluid to flow axially past the piston when arranged in the bore.

The, or each, bypass channel may extend from a downhole end wall of the body and be arranged to convey fluid to the cavity.

The body may define a plurality of the bypass channels and a complementary plurality of ports, each port arranged to fluidly couple the cavity and one of the bypass channels.

The bypass channels may be arranged in an annular array spaced evenly about the axis.

The body may define an external sidewall and the, or each, bypass channel open out to the external sidewall.

The body may also include an engaging portion configured to releasably engage a plug across the cavity to substantially seal the cavity. The engaging portion may include an annular groove defined in an internal sidewall, and at least a pair of longitudinal grooves extending to the annular groove.

According to a further aspect of the disclosure, there is provided an assembly for mounting within a core tube, the assembly including a downhole tool for obtaining core orientation data, and a core ejection piston having a downhole end, an opposed uphole end, and a cavity extending between the ends to define an axis and configured to receive the downhole tool. The piston is dimensioned to slidingly engage the core tube, and defines at least one bypass channel arranged to allow fluid to flow past the piston when arranged in the core tube.

The assembly may also include a plug having a body dimensioned to slidingly engage the cavity of the piston, the plug including at least a pair of projections extending away from the body, and the piston further define an engaging portion including an annular groove defined in an internal sidewall, and at least a pair of longitudinal grooves extending to the annular groove, each longitudinal groove dimensioned to receive one of the projections to allow passing the projections along the longitudinal grooves and into the annular groove to releasably engage the plug with the piston.

According to another aspect of the disclosure, there is provided a method for extracting a core from bedrock and measuring one or more parameters relating to the core, the method including: arranging at least one sleeve about a downhole tool and within a pair of split tubes of a core barrel assembly defining a bore, the, or each, sleeve dimensioned to slidingly engage the split tubes to inhibit radial movement of the split tubes relative to the bore, and shaped to receive the downhole tool to allow retaining the downhole tool coaxially with the bore; operating a drilling rig to drill the core from the bedrock and be received in the split tubes, concurrently with operating the downhole tool to measure the one or more parameters; retrieving the core barrel assembly to the surface; operating the tool to obtain measured data; mounting a piston plug within the core barrel assembly to seal the bore; and directing fluid against the piston plug to cause the core and split tubes to be expelled from the core tube.

The method may involve, before mounting the piston plug, the at least one sleeve and data acquisition tool being removed from the core barrel assembly.

The method may involve, before mounting the piston plug, the plug being connected to an ejection piston to form a piston assembly, and mounting the piston plug include fitting the piston assembly across the core tube to seal against the bore.

The method may involve, before mounting the piston plug, the data acquisition tool being removed from the core barrel assembly, and mounting the piston plug includes sealingly engaging the plug with the at least one sleeve.

The downhole tool may be configured as a core orientation tool, and operated to measure parameters relating to orientation of the core when breaking from the bedrock.

According to a further disclosed aspects, there is provided a housing assembly for a downhole tool. The housing assembly includes: a coupling adaptor having an uphole end defining a first engagement structure for engaging a component of a backend assembly, and an opposed downhole end defining a second engagement structure for engaging a core tube, the coupling adaptor further defining a bore extending between the ends and a plurality of protrusions extending radially into the bore; and a tool body having an uphole end, an opposed downhole end and a longitudinal axis extending between the ends, the tool body including a sealable cavity dimensioned to receive a payload, and defining a plurality of coupling channels, each channel dimensioned to receive one of the protrusions and defining a pair of axial portions extending parallel to the axis and spaced apart about the axis, and a joining portion extending circumferentially about the axis to join the axial portions. Arranging the tool body within the bore of the coupling adaptor, and sliding each of the protrusions along each portion of one of the channels, mounts the tool body to the coupling adaptor.

Each channel may have a first axial portion arranged towards the downhole end, and a second axial portion arranged towards the uphole end, and the joining portion be arranged to extend axially and circumferentially from the first axial portion to the second axial portion such that the joining portion slopes towards the downhole end. Furthermore, each joining portion may be shaped to be at least partly helical about the axis.

The joining portion may extend between a location defined by each axial portion, where at least one of the locations is spaced partway along the respective axial portion.

The joining portion may extend from an uphole end of the first axial portion to a location partway along the second axial portion.

The coupling adaptor may include three or more of the protrusions arranged in an annular array, and the tool body may define a complementary three or more of the coupling channels arranged in annular array.

The tool body may define a plurality of axially extending flow paths arranged to allow liquid to flow towards and past the uphole end of the tool body when mounted to the coupling adaptor, and the tool body may further define an annular check-valve surface arranged at, or spaced axially from, a downhole end of the flow paths, the check-valve surface being shaped to taper towards the downhole end of the tool body.

The coupling adaptor may define an annular seat surface shaped to abut the check-valve surface of the tool body such that arranging the check-valve surface against the seat surface inhibits liquid flowing through the bore and out of the downhole end of the coupling.

The housing assembly may include an end member rotatably mounted at the downhole end of the tool body. The end member may be configured as a protective bumper and arranged to abut obstacles. The end member may define a conical portion arranged to taper away from the downhole end of the tool body. The end member may define an annular array of grooves arranged to allow liquid to flow past the end member when the tool body is mounted to the coupling adaptor. The annular array of grooves may be arranged to receive the plurality of protrusions of the coupling adaptor, such that passing the protrusions through the grooves causes the coupling adaptor to be coaxial to the tool body.

Each of the first engagement structure and the second engagement structure may include a thread, and the thread of the first engagement structure may define at least one of a different pitch, diameter, and thread angle than the thread of the second engagement structure. The second engagement structure may be configured to engage a standard size core tube.

The array of protrusions may extend from an annular flange arranged to extend into the bore.

The housing assembly may include a split tube spacer defining an internal diameter dimensioned to slidingly engage a portion of the tool body and an external profile shaped to at least one of slidingly engage an inside of each of a pair of split tubes, and abut an uphole end of each of a pair of split tubes, so that, in use, the spacer is arrangeable to inhibit at least one of axial and radial movement of the split tubes relative to a core tube.

The split tube spacer may define one or more structures arranged to allow liquid to flow past the tool body in an uphole direction when the split tube spacer is carried by the tool body and the tool body is mounted to the coupling adaptor.

The payload may include electronic components and at least one battery.

The electronic components may be configured for measuring orientation of a core sample in situ, prior to being broken from bedrock.

The housing assembly may also include a plug slidably mounted to the tool body to seal the sealable cavity, and the tool body define one or more vent recesses arranged at, or adjacent, the uphole end to allow venting of fluid from within the sealable cavity when the plug is partially removed from the tool body.

In another disclosed aspect, there is provided a housing assembly for a downhole tool, the housing assembly including: a coupling adaptor having an uphole end defining a first engagement structure for engaging a component of a backend assembly, and an opposed downhole end defining a second engagement structure for engaging a core tube, the coupling adaptor further defining a bore extending between the ends and a protrusion extending radially into the bore; and a tool body having an uphole end, an opposed downhole end and a longitudinal axis extending between the ends, the tool body including a sealable cavity dimensioned to receive a payload, and defining a coupling channel dimensioned to receive the protrusion, the channel defining a pair of axial portions extending parallel to the axis and spaced apart about the axis, and a joining portion extending circumferentially about the axis to join the axial portions, where arranging the tool body within the bore of the coupling adaptor, and sliding the protrusion along each portion of the channel, mounts the tool body to the coupling adaptor.

In another disclosed aspect, there is provided a housing assembly for a downhole tool, the housing assembly including: a tool body having an uphole end, an opposed downhole end and a longitudinal axis extending between the ends, the tool body including a sealable cavity dimensioned to receive a payload, and defining one or more radially extending protrusions; and a coupling adaptor having an uphole end defining a first engagement structure for engaging a component of a backend assembly, and an opposed downhole end defining a second engagement structure for engaging a core tube, the coupling adaptor further defining a bore extending between the ends and one or more coupling channels, wherein the, or each, channel is dimensioned to receive one of the one or more protrusions, and the, or each, channel defines a pair of axial portions extending parallel to the axis and spaced apart about the axis, and a joining portion extending circumferentially about the axis to join the axial portions, where arranging the tool body within the bore of the coupling adaptor, and sliding the one or more protrusions along each portion of the one or more channels, mounts the tool body to the coupling adaptor.

According to further disclosed aspects, there is provided kit for housing a downhole tool, the kit including: a plurality of coupling adaptors, each coupling adaptor having an uphole end defining a first engagement structure configured to engage a component of a backend assembly, and an opposed downhole end defining a second engagement structure configured to engage a specific core tube, each coupling adaptor further defining a bore extending between the ends and at least one protrusion extending radially into the bore; and a tool body having an uphole end, an opposed downhole end and a longitudinal axis extending between the ends, the tool body including a sealable cavity dimensioned to receive a payload, and defining a complementary at least one coupling channel, the, at least one channel dimensioned to receive the at least one protrusion, the, or each channel defining a pair of axial portions extending parallel to the axis and spaced apart about the axis, and a joining portion extending circumferentially about the axis to join the axial portions, where arranging the tool body within the bore of the coupling adaptor, and sliding the at least one protrusion along each portion of the at least one channel, mounts the tool body to the coupling adaptor, and where each of the coupling adaptors are configured to engage a different core tube to allow mounting the tool body to a range of alternatively dimensioned core tubes.

According to further disclosed aspects, there is provided kit for housing a downhole tool, the kit including a tool body having an uphole end, an opposed downhole end and a longitudinal axis extending between the ends, the tool body including a sealable cavity dimensioned to receive a payload, and defining one or more radially extending protrusions; and a coupling adaptor having an uphole end defining a first engagement structure for engaging a component of a backend assembly, and an opposed downhole end defining a second engagement structure for engaging a core tube, the coupling adaptor further defining a bore extending between the ends and one or more coupling channels, wherein the, or each, channel is dimensioned to receive one of the one or more protrusions, and the, or each, channel defines a pair of axial portions extending parallel to the axis and spaced apart about the axis, and a joining portion extending circumferentially about the axis to join the axial portions, where arranging the tool body within the bore of the coupling adaptor, and sliding the one or more protrusions along each portion of the one or more channels, mounts the tool body to the coupling adaptor, and where each of the coupling adaptors are configured to engage a different core tube to allow mounting the tool body to a range of alternatively dimensioned core tubes.

According to further disclosed aspects, there is provided a downhole assembly including the housing assembly as described in any of the above paragraphs and a backend assembly having a component configured to engage the first engagement structure of the coupling adaptor, the component defining a recess dimensioned to slidingly engage the uphole end of the tool body.

The recess may be shaped to allow a defined range of axial displacement of the tool body relative to the coupling adaptor when the coupling adaptor is engaged with the component of the backend assembly.

The component may be configured as a grease cap defining an uphole end and an opposed downhole end, and a cavity configured to, in use, contain grease, and further defines a port configured to allow fluid to be introduced into the cavity, the port arranged towards the uphole end of the grease cap. The grease cap may define at least one water port, and an exterior surface of the grease cap define at least one axially extending track aligned with the at least one water port. The grease cap may define an annular array of the water ports, and further defines a complementary annular array of the axially extending tracks, such that each track is aligned with one of the water ports. According to further disclosed aspects, the kit as described in the above paragraphs may further comprise the component of the backend assembly. The component may be a grease cap as described herein.

According to another disclosed aspect, there is provided a method of assembly a housing assembly for a downhole tool, the method including: arranging a tool body, carrying a payload, within a bore defined by a coupling adaptor to cause inserting at least one pin extending from the coupling adaptor into a complementary at least one coupling channel defined by the tool body; axially displacing the tool body relative to the adaptor to slide the at least one pin along a first portion of the at least one channel; rotating the tool body relative to the adaptor to slide the at least one pin along a second portion of the at least one channel; and axially displacing the tool body relative to the adaptor to slide the at least one pin along a third portion of the at least one channel to cause the tool body to be mounted to the coupling adaptor.

According to yet another disclosed aspect, there is provided a method of assembling a downhole assembly, the method including: arranging a tool body, carrying a payload, within a bore defined by a coupling adaptor to cause inserting a plurality of pins extending from the coupling adaptor into a complementary plurality of coupling channels defined by the tool body; axially displacing the tool body relative to the adaptor to slide the pins along a first portion of the channels; rotating the tool body relative to the adaptor to slide the pins along a second portion of the channels; axially displacing the tool body relative to the adaptor to slide the pins along a third portion of the channels to cause the tool body to be mounted to the coupling adaptor; engaging an uphole end of the coupling adaptor with a component of a backend assembly; and engaging a downhole end of the coupling adaptor with a core tube to arrange the tool body at an uphole end of the core tube.

The method may also include engaging the coupling adaptor with the component of the backend assembly such that the tool body is trapped between the backend assembly and the coupling adaptor.

It will be appreciated embodiments may comprise steps, features and/or integers disclosed herein or indicated in the specification of this application individually or collectively, and any and all combinations of two or more of said steps or features.

BRIEF DESCRIPTION OF DRAWINGS

Embodiments will now be described by way of example only with reference to the accompany drawings in which:

FIGS. 28 to 29B are detailed cross-section views of the downhole assembly as illustrated in FIG. 27, where FIGS. 29A and 29B show different configurations of check-valve features.

DESCRIPTION OF EMBODIMENTS

Figure 1:
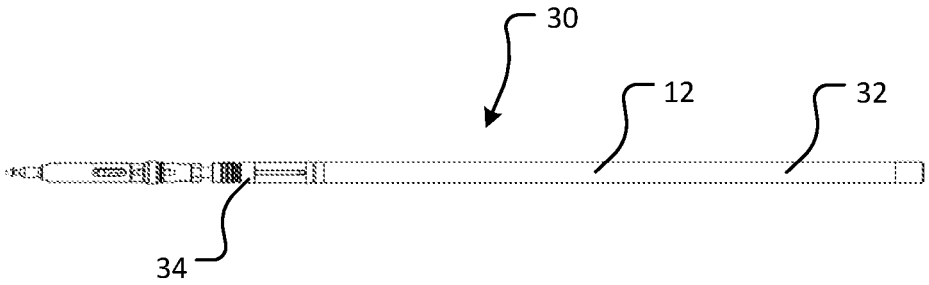
FIG. 1 is a side view of a downhole assembly including a N3 core barrel assembly.
Figure 2:
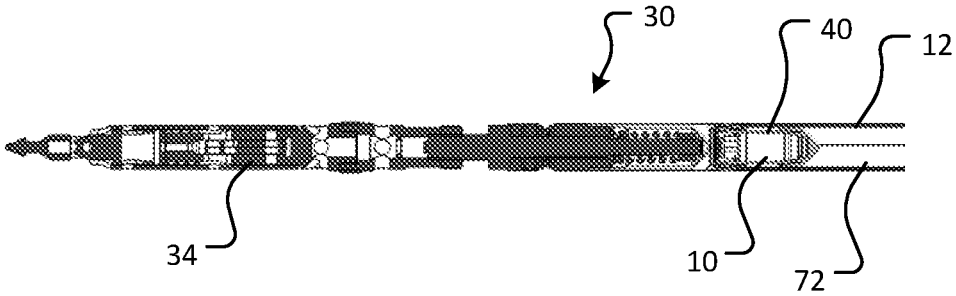
FIG. 2 is a cross-sectioned, detailed view of part of the assembly shown in FIG. 1.
Figure 3:
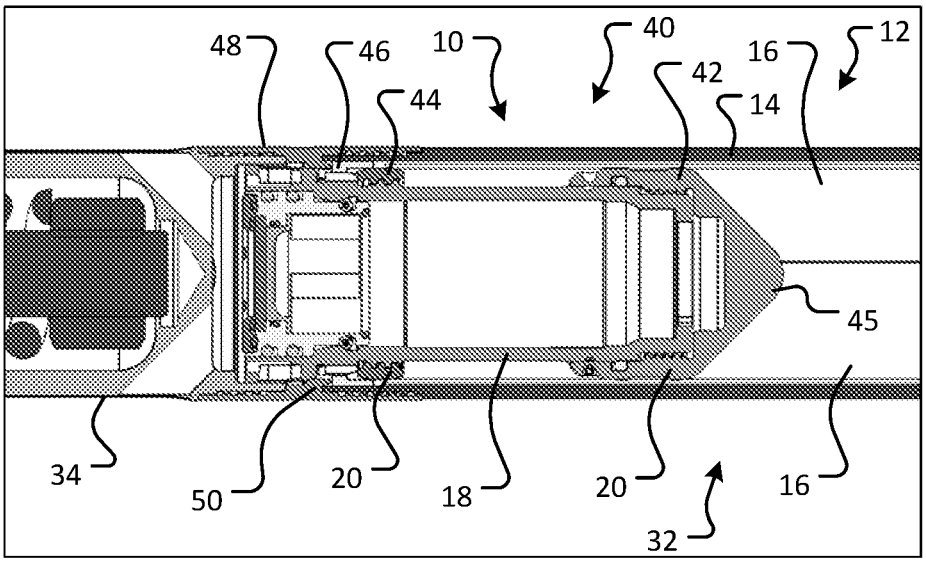
FIG. 3 is a cross-sectioned, detailed view of part of the assembly shown in the previous figures, illustrating a first embodiment of a downhole tool assembly.
Figure 4:
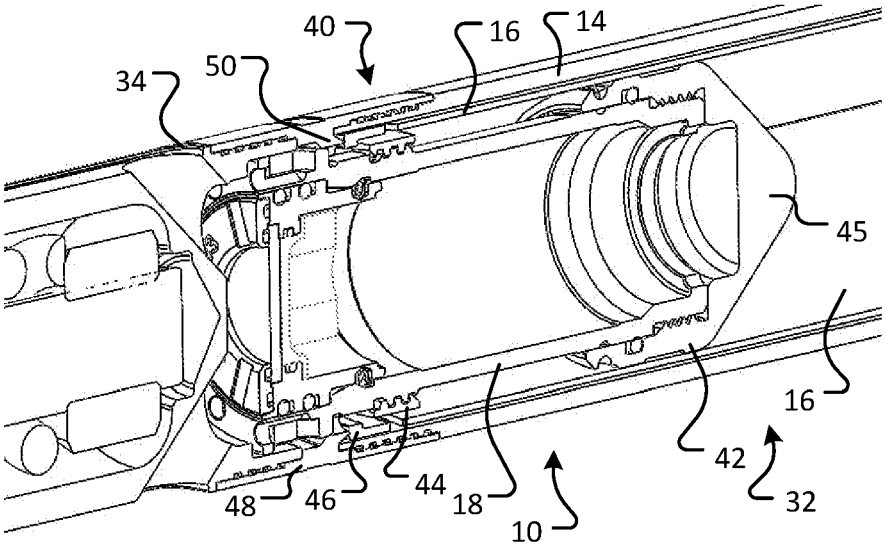
FIG. 4 is a cross-sectioned, perspective detailed view of the downhole tool assembly shown in FIG. 3.

In the drawings, reference numeral 10 generally designates a downhole tool assembly 10 for mounting to a core barrel assembly 12 including a core tube 14 defining a bore and a pair of split tubes 16 arranged within the core tube 14 and adjacent to each other to surround the bore. The downhole tool assembly 10 includes a downhole tool 18, and at least one sleeve 20 dimensioned to slidingly engage the split tubes 16 to inhibit radial movement of the split tubes 16 relative to the bore. The, or each, sleeve 20 is shaped to receive and retain the downhole tool 18 coaxially with the bore.

FIGS. 1 to 6 illustrate a first embodiment of a downhole assembly 30. The assembly 30 includes the core barrel assembly 12, configured as an industry standard NQ3 triple-tube core barrel assembly 32. It will be appreciated that NQ3 assemblies are shaped and configured to receive a specifically dimensioned core within the split tubes 16. A first embodiment 40 of the downhole tool assembly 10 is mounted to a back-end of the core barrel assembly 32 to arrange the tool 18 substantially within the core barrel assembly 32. A back-end assembly 34 is mounted to the downhole tool assembly 40 and arranged to allow wireline retrieval of the downhole tool assembly 40 and core tube 14, containing the split tubes 16 and core (not illustrated), to the surface.

The downhole tool assembly 40 includes a pair of the sleeves 20, configured as a first sleeve 42 and second sleeve 44. The first sleeve 42 is configured to receive and engage a downhole end of the tool 18. The second sleeve 44 is configured to be arranged partway along and engage the tool 18. In other embodiments (not illustrated), the second sleeve 44 is configured to engage the uphole end of the tool 18. The sleeves 42, 44 are configured to threadedly engage the tool 18 however it will be appreciated that other engagement mechanisms are within the scope of this disclosure. In this embodiment 40, the tool 18 is configured as a core orientation tool operable to record orientation data. It will be appreciated that the assembly 40 is configurable to mount alternative data acquisition tools, sensors, or other tools or instruments, to the core barrel assembly 12. It will also be appreciated that only the casing of the tool 18 is illustrated for simplicity and that, in practice, the tool 18 includes electronic components and circuitry housed within the casing, such as sensors, PCBs, microprocessors, batteries, communication modules, or the like.

Figure 5:
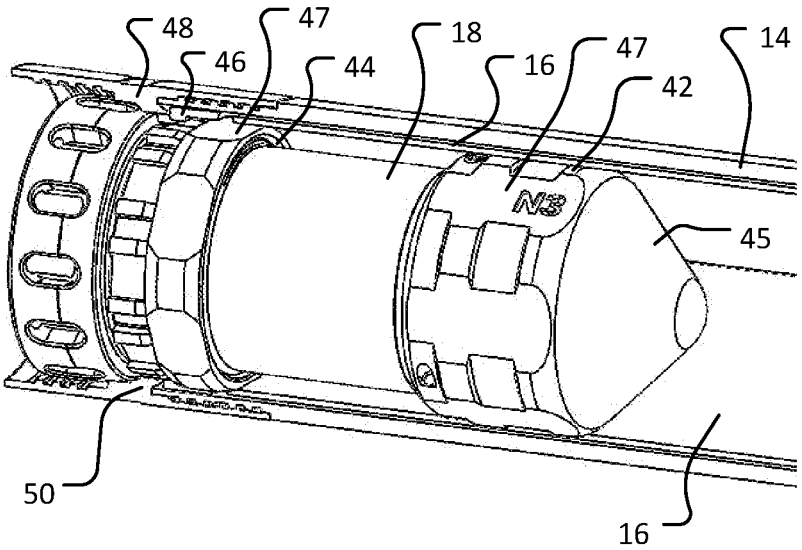
FIG. 5 is a partial section, perspective detailed view of the downhole tool assembly shown in FIGS. 3 and 4.

Best shown in FIG. 5, the first sleeve 42 defines a tapered end portion 45 configured to face downhole and direct fluid flow upstream along the bore and past the sleeve 42. In the illustrated embodiment, the end portion 45 defines a conical nose cone. The nose cone has a rounded tip which may minimise contact with a core received within the split tubes 16 and/or enhance protecting the tool 18 from impact with the core. It will be appreciated that the end portion 45 may be alternatively shaped to direct fluid flow axially past the sleeve 42.

The second sleeve 44 is configured as a continuous ring dimensioned to surround the tool 18. In other embodiments (not illustrated), the first sleeve 42 and/or the second sleeve 44 is formed from, or includes, discontinuous portions securable in an annular array about the tool 18, such as a plurality of radially extending fins or splines, to allow slidingly engaging the split tubes 16. In yet other embodiments (not illustrated), one or both sleeves 42, 44 comprise a non-continuous section configured to partially surround the tool 18, such as a C-shaped section. Such embodiments may be useful to allow the sleeve 42, 44 to flex relative to the tool 18, for example, to enhance fitting to the tool 18, and/or to decrease friction between the sleeve 42, 44 and the tool 18.

Engaging the sleeves 42, 44 to the tool 18 and sliding the sleeves 42, 44 inside the split tubes 16 allows positioning the tool 18 within and coaxially to the bore of the core barrel assembly 12. When arranged in this way, the sleeves 42, 44 inhibit radial movement of the split tubes 16, consequently reducing instances of, or preventing, the split tubes 16 overlapping, which could block a core being receiving within the core barrel assembly 12.

Each sleeve 42, 44 is shaped to allow fluid to flow along the bore of the core tube 14 and past the sleeve 42, 44. In the illustrated embodiment 40, and best shown in FIG. 5, each sleeve 42, 44 defines an annular array of bypass surfaces 47, configured as planar surfaces. In other embodiments (not illustrated), one or more of the sleeves 42, 44 at least partially defines one or more channels arranged to allow fluid flow past the sleeve 42, 44. In yet other embodiments (not illustrated), one or more of the sleeves sleeve 42, 44 defines at least one bypass conduit extending through the sleeve 42, 44.

The downhole tool assembly 40 also includes a retaining portion configured to be arranged against an uphole end of each split tube 16 to inhibit axial movement of the split tubes 16 relative to the bore of the core tube 14, for example, during drilling of the core. In this embodiment 40, and best shown in FIGS. 3 and 4, the retaining portion is configured as a retaining sleeve 46 fitted about the tool 18 within the core tube 14 and interposed between the split tubes 16 and a coupling 48 engaged with the core tube 14. The coupling 48 is configured to inhibit axial movement of the retaining sleeve 46, in this embodiment 40, including an internal flange 50 shaped to be immediately adjacent or abut the retaining sleeve 46 when mounted to the core tube 14. Best shown in FIG. 3, the flange 50 is also arranged to inhibit axial movement of the tool 18 in a downhole direction. Axial movement of the tool 18 in an uphole direction is limited by the back-end assembly 34. The coupling 48 is further configured to engage the back-end assembly 34. The coupling 48 is shown as threadedly engaging the core tube 14 and the back-end assembly 34 however it will be appreciated that other engaging mechanisms are within the scope of this disclosure.

Figure 6:
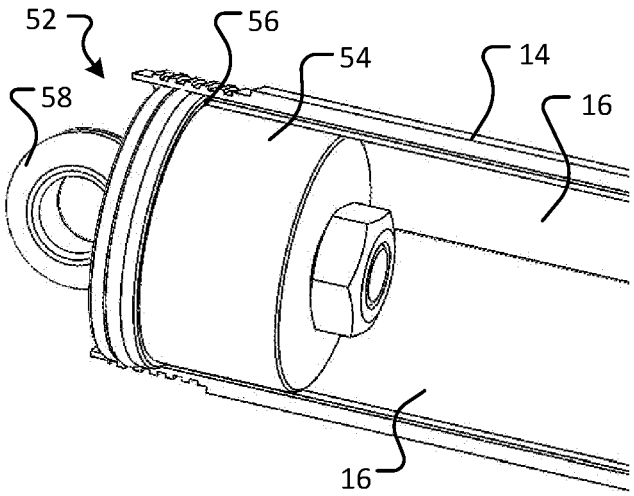
FIG. 6 is a partial section, perspective detailed view of an ejection piston assembly fitted to the core barrel assembly shown in the previous figures.
Figure 7:
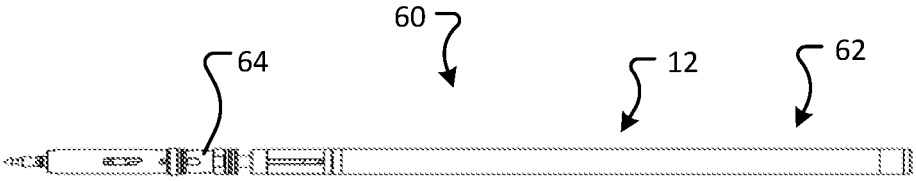
FIG. 7 is a side view of a downhole assembly including a H3 core barrel assembly.
Figure 8:
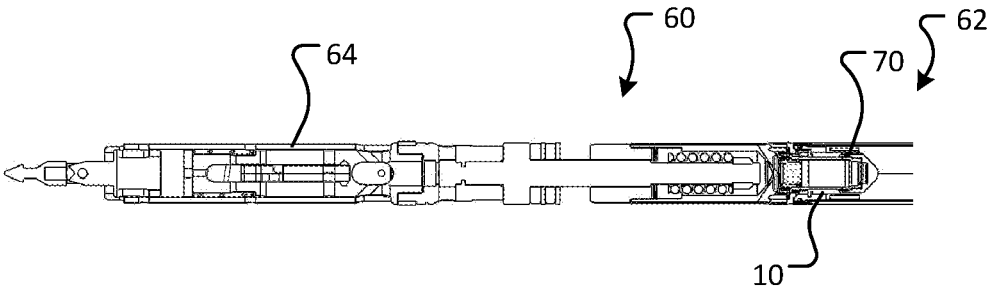
FIG. 8 is a cross-sectioned, detailed view of part of the assembly shown in FIG. 7.
Figure 9:
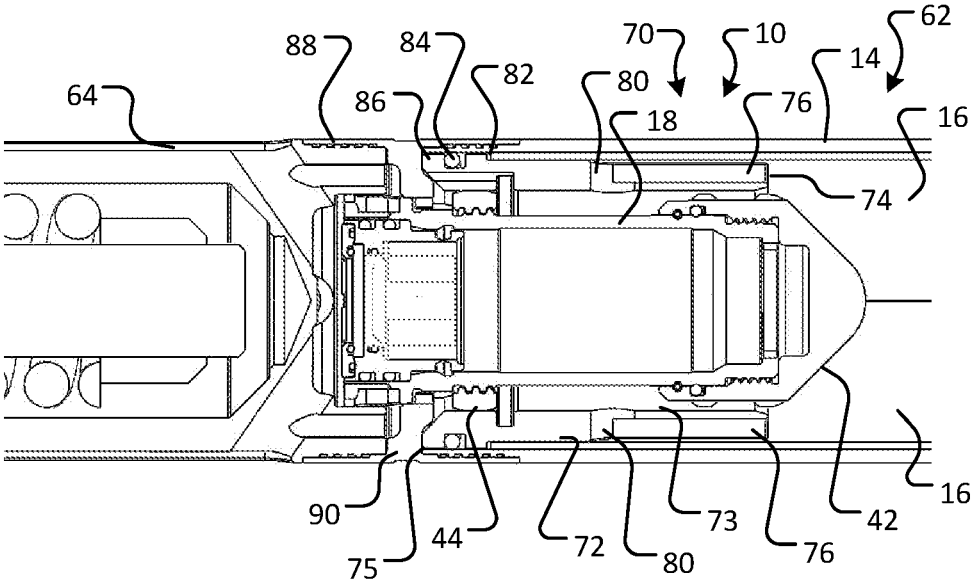
FIG. 9 is a cross-sectioned, detailed view of part of the assembly shown in FIGS. 7 and 8, illustrating a second embodiment of a downhole tool assembly.
Figure 10:
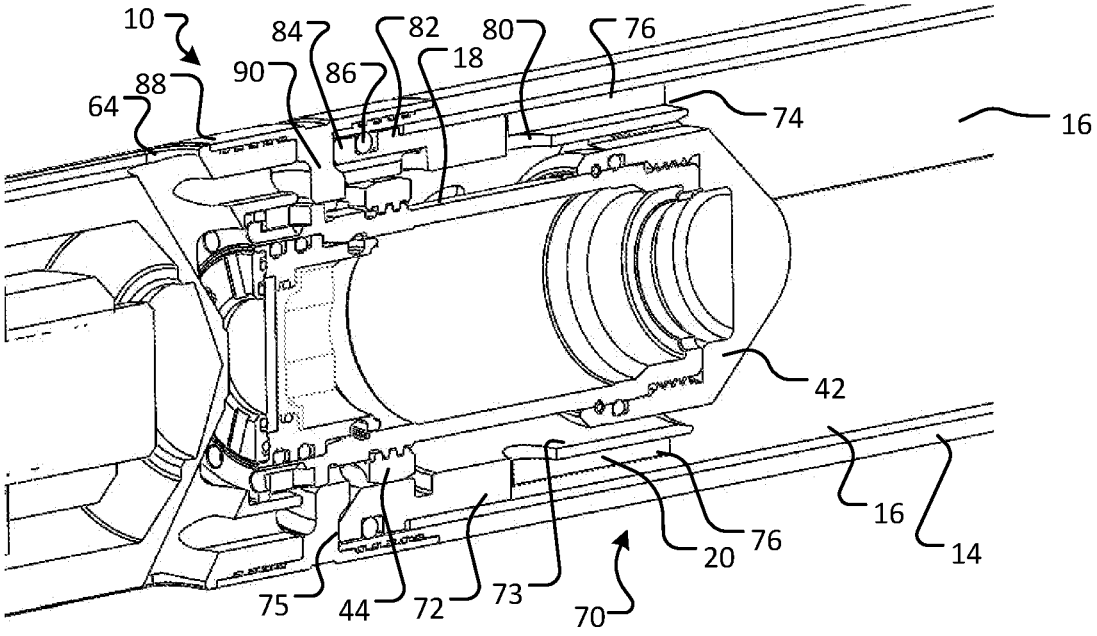
FIG. 10 is a cross-sectioned, perspective detailed view of the downhole tool assembly shown in FIG. 9.
Figure 11:
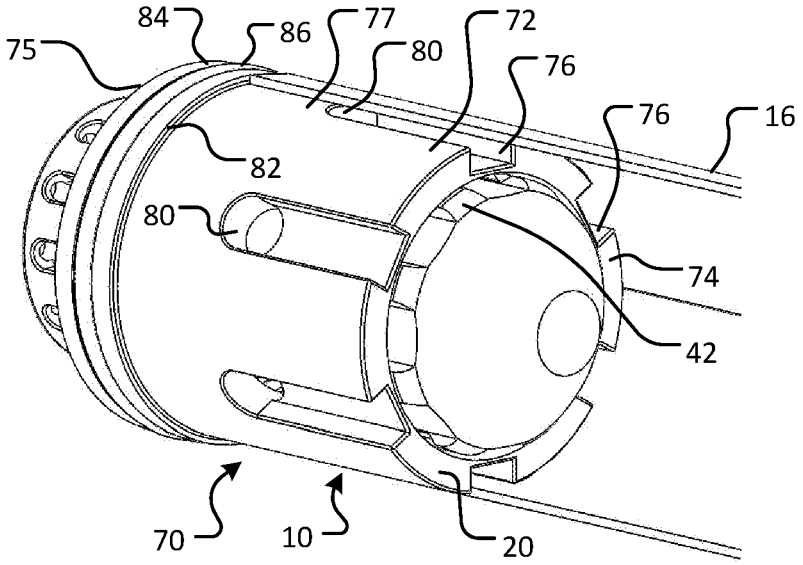
FIG. 11 is a partial section, perspective detailed view of the downhole tool shown in FIGS. 9 and 10.

FIG. 6 shows the assembly 30 alternatively configured such that the downhole tool assembly 40 has been removed from the core tube assembly 32 and substituted with an ejection piston assembly 52. The piston assembly 52 includes a piston 54 shaped to slidingly engage the split tubes 16, and defining a shoulder 56 arranged to abut the uphole ends of the split tubes 16. A plug 58 defining an eyelet 59 is secured through an aperture defined by the piston 54. The piston assembly 52 is typically located at the surface in a pre-assembled state and mounted to the core tube assembly 32 to allow removing the split tubes 16 and a core from the core tube 14, as described in greater detail below.

FIGS. 7 to 11 illustrate a second embodiment of a downhole assembly 60. The assembly 60 includes the core barrel assembly 12, configured as an industry standard HQ3 triple-tube core barrel assembly 62. It will be appreciated that HQ3 assemblies are shaped and configured to receive a specifically dimensioned core within the split tubes 16. A second embodiment 70 of the downhole tool assembly 10 is mounted to a back-end of the core barrel assembly 62 to arrange the tool 18 substantially within the core barrel assembly 62. A back-end assembly 64 is mounted to the downhole tool assembly 70 and arranged to allow wireline retrieval of the downhole tool assembly 70 and core tube 14, containing the split tubes 16 and core (not illustrated), to the surface.

The downhole tool assembly 70 includes a single sleeve 20, configured as a core ejection piston 72. The piston 72 defines a cavity 73 extending between opposed ends and is shaped to receive and retain the downhole tool 18 in the cavity 73. The piston 72 has a peripheral region, in this embodiment bound by an outer sidewall 77, dimensioned to slidingly engage the split tubes 16. In this embodiment 70, the tool 18 is again configured as a core orientation tool operable to record orientation data during drilling. It will be appreciated that the assembly 70 is configurable to mount alternative sensors, tools and instruments to the core barrel assembly 12. Again, it will be appreciated that only the casing of the tool 18 is illustrated for simplicity and that, in practice, the tool 18 includes electronic components and circuitry housed within the casing, such as sensors, PCBs, microprocessors, batteries, communication modules, or the like.

In the illustrated embodiment 70, the tool 18 is engaged with alternative embodiments of the first sleeve 42 and the second sleeve 44, each dimensioned to fit within the cavity 73 to allow arranging the tool 18 coaxially with the piston 72. In this embodiment, only the second sleeve 44, configured as a retainer ring, is dimensioned to slidingly engage the cavity 73 to inhibit radial movement of the tool 18 relative to the piston 72 and arrange the tool coaxially with the piston 72. It will be appreciated that, in other embodiments (not illustrated), the first sleeve 42 is additionally, or alternatively, dimensioned to slidingly engage the cavity 73. In yet other embodiments (not illustrated), the sleeves 42, 44 are absent and, instead, the piston 72 and/or tool 18 define a structure to allow positioning the tool 18 within the cavity 73 of the piston 72.

Securing the tool 18 within the piston 72, and sliding the piston 72 inside the split tubes 16, allows positioning the tool 18 within and coaxially to the bore of the core barrel assembly 12. When arranged in this way, the piston 72 inhibits radial movement of the split tubes 16, consequently reducing instances of, or preventing, the split tubes 16 overlapping, which could block a core being receiving within the core barrel assembly 12

The piston 72 is shaped to allow fluid to flow along the bore of the core tube 14 and past the piston 72. In the illustrated embodiment 70, and best shown in FIG. 11, the piston 72 has a downhole end wall 74 and defines a plurality of bypass channels 76 extending from the end wall 74 axially along, and opening out into, the outer wall 77 of the piston 72. The channels 76 are arranged in an annular array concentrically to the cavity 73. A complementary plurality of ports 80 are defined in the piston 72 to fluidly couple each channel 76 to the cavity 73. The channels 76 are arranged to direct fluid to flow axially from the end wall 74 into and through the cavity 73 to exit from an uphole end 75 of the piston 72. It will be appreciated that, in other embodiments (not illustrated), the piston 72 may define more or less bypass channels 76, being as few as a single channel 76, and that the channel(s) 76 may be alternatively arranged and/or configured to allow fluid to flow axially along the bore and past the piston 72, such as by being arranged to extend the entire length of the piston 72.

The downhole tool assembly 70 includes a retaining portion configured to be arranged against an uphole end of each split tube 16 to inhibit axial movement of the split tubes 16 relative to the bore of the core tube 14, for example, during drilling of the core. In this embodiment 70 and best shown in FIG. 11, the retaining portion is configured as a shoulder 82 defined by, and integrally formed with, the piston 72. Adjacent the shoulder is a seal portion 84 carrying a seal 86. Best shown in FIG. 9, the seal portion 84 is dimensioned to fit within the core tube 14 and be interposed between the split tubes 16 and a coupling 88 engaged with the core tube 14. The coupling 88 is configured to inhibit axial movement of the piston 72, in this embodiment 70, shaped to have an internal flange 90 arranged to be immediately adjacent or abut the piston 72 when the coupling 88 is mounted to the core tube 14. The flange 90 is also arranged to inhibit axial movement of the tool 18 in a downhole direction. Axial movement of the tool 18 in an uphole direction is limited by the back-end assembly 64. The coupling 88 is further configured to engage the back-end assembly 64.

Figure 12:
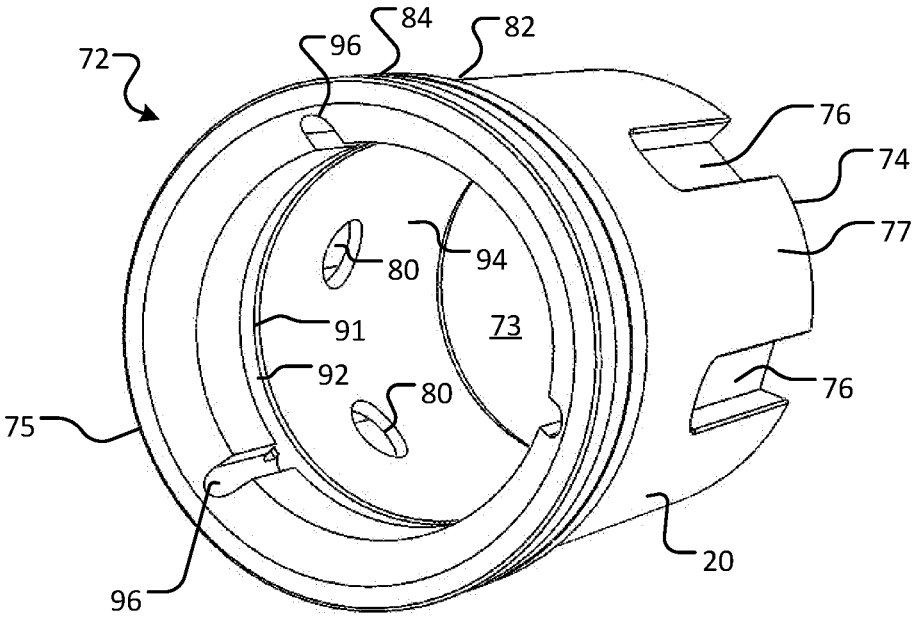
FIG. 12 is a perspective view of the piston of the downhole tool assembly shown in FIGS. 9 to 11.

FIG. 12 shows the piston 72 in isolation. The piston 72 includes an engaging portion 91 configured to allow releasably engaging a plug assembly 100 (FIG. 13) with the piston 72 to substantially seal the cavity 73. In the illustrated embodiment 70, the engaging portion 91 includes an annular groove 92 defined in an internal sidewall 94, and at least a pair of longitudinal grooves 96 extending to the annular groove 92. This arrangement allows sliding the plug 100 along the longitudinal grooves 96, into the annular groove 92, and rotating the plug 100 to cause engagement with the piston 72.

Figure 13:
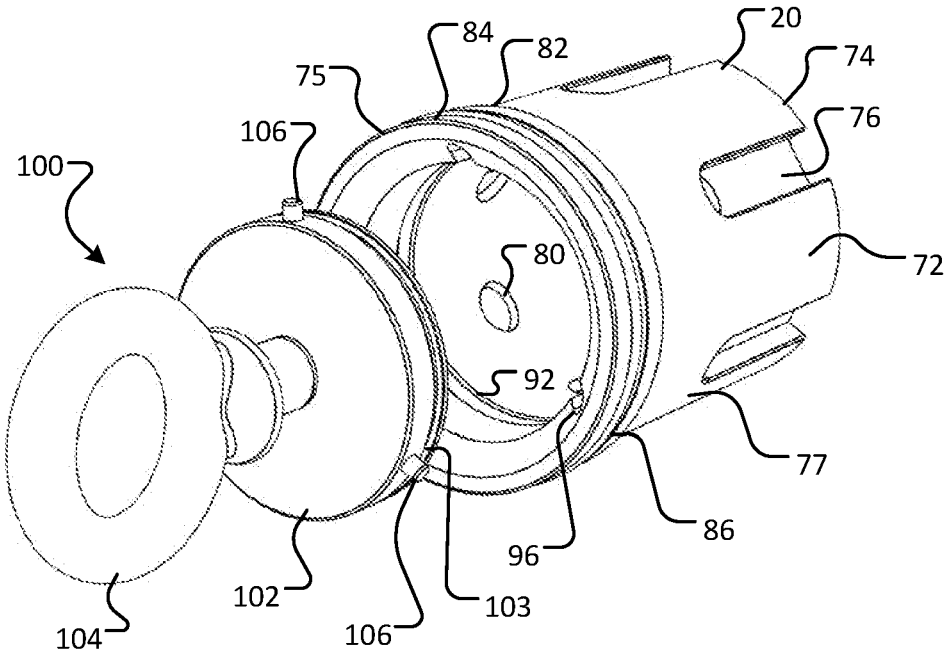
FIG. 13 is an exploded, perspective view of a plug assembly and the piston of FIG. 12.

FIG. 13 shows the plug assembly 100 spaced from the piston 72. The plug assembly 100 includes a body 102 is dimensioned to slidingly engage the cavity 73 of the piston 72. In this embodiment 100, the body 102 carries a compressible seal 103 to allow sealing against the internal sidewall 94. An eyelet 104 is arranged to extend from, and is rotationally coupled with, the body 102. A plurality of projections 106 extend from the body 102. The projections 106 are configured to fit within the grooves 92, 96 of the piston 72 and arranged to be slid along the longitudinal grooves 96 to be received in the annular groove 92.

FIGS. 14 to 17 show an alternative downhole assembly configured as a housing assembly 120 for a downhole tool. The housing assembly 120 is configured to sealably contain a payload 122 (FIG. 15), in this embodiment being the components of a digital core orientation device or instrument operable to measure orientation of a core sample in situ, prior to, or immediately after, being broken from bedrock. It will be appreciated that the housing assembly 120 is configurable to contain other payloads, such as alternative digital systems operable to measure parameters and record data, for example, a gyro for downhole surveying.

The housing assembly 120 includes a coupling adaptor 124 and a tool body 126. The coupling adaptor 124 has an uphole end 128 defining a first engagement structure 130 for engaging a component of a backend assembly 132 (FIG. 24, also known as a head assembly), and an opposed downhole end 134 defining a second engagement structure 136 for engaging a core tube 138 (FIG. 24, also known as an inner tube or core barrel). The coupling adaptor 124 also defines a bore 140 (FIG. 16) extending between the ends 128, 134 and a plurality of protrusions 142 extending radially into the bore 140.

The tool body 126 has an uphole end 144, an opposed downhole end 146 and a longitudinal axis 148 extending between the ends 144, 146. The tool body 126 includes a sealable cavity 150 (FIG. 15) dimensioned to receive the payload 122, and defines a plurality of coupling channels 152. Each coupling channel 152 is dimensioned to receive one of the protrusions 142 of the coupling adaptor 124, and includes a pair of axial portions 154 extending parallel to the axis 148 and spaced apart about the axis 148, and a joining portion 156 extending circumferentially about the axis 148 to join the axial portions 154.

Figure 14:
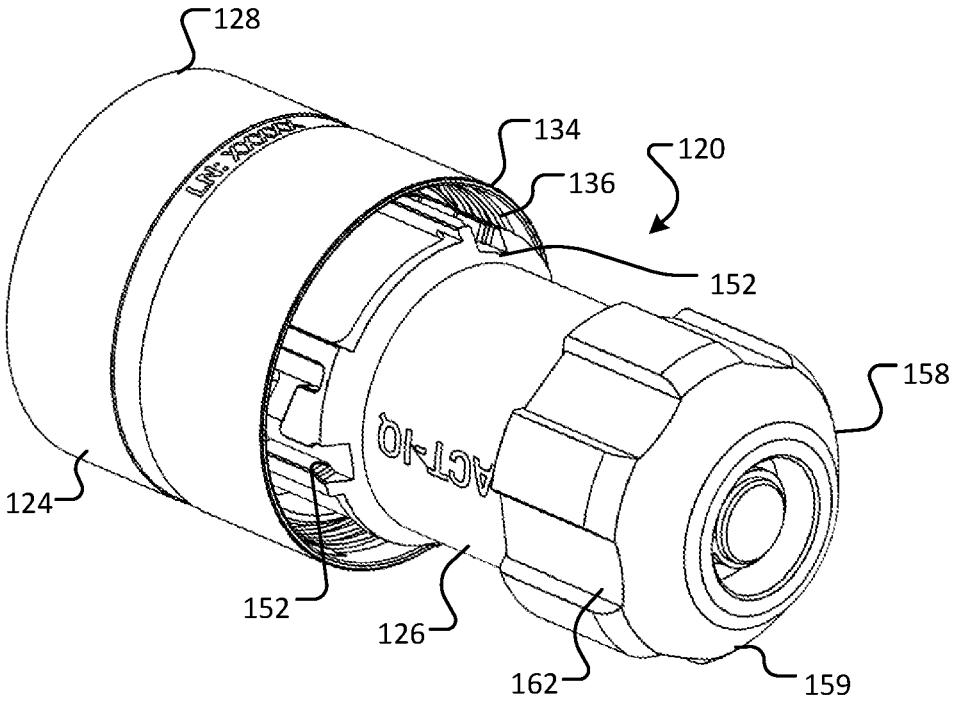
FIG. 14 is a perspective view of an alternative downhole assembly configured as a housing assembly for a downhole tool.
Figure 15:
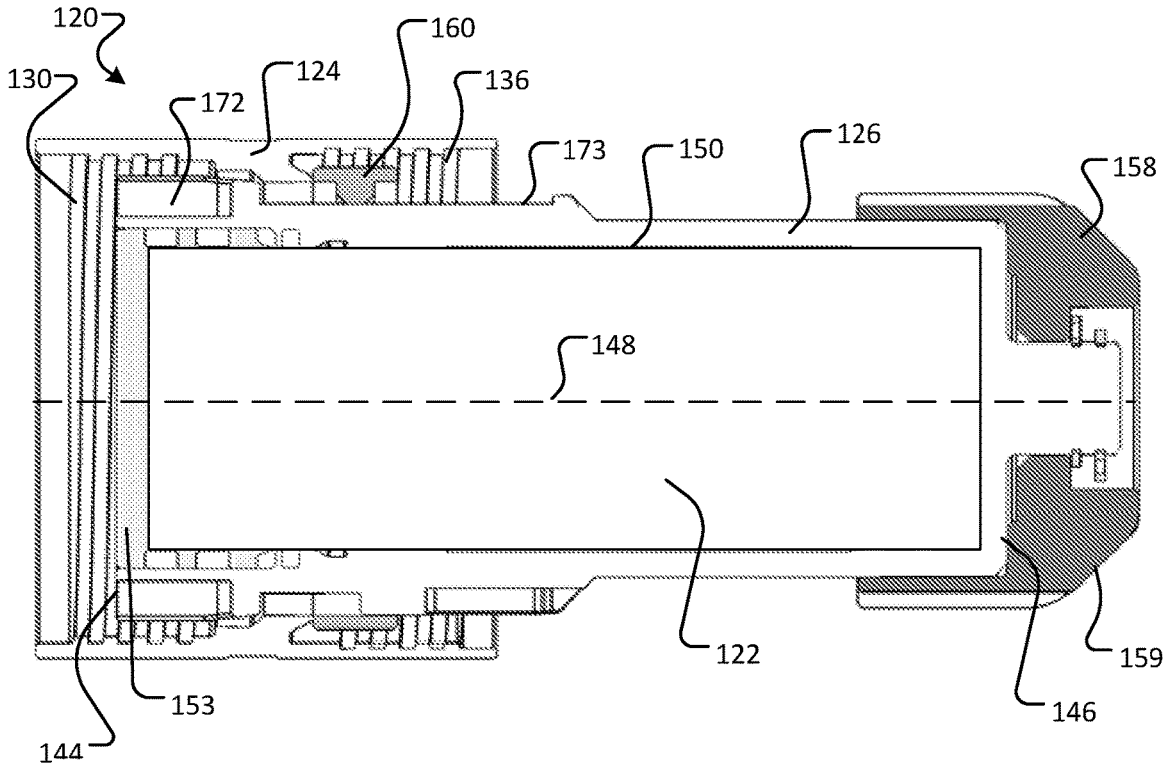
FIGS. 15 to 17 are cross-section and exploded views of the housing assembly shown in FIG. 14.

As shown in FIGS. 14 and 15, arranging the tool body 126 within the bore 140 of the coupling adaptor 124, and sliding each of the protrusions 142 along each portion 154, 156 of a corresponding one of the channels 152, mounts the tool body 126 to the coupling adaptor 124.

The illustrated embodiment 120 shows the coupling adaptor 124 having a plurality of protrusions 142 and the tool body 126 having a complementary plurality of coupling channels 152. This arrangement is generally useful as this allows centralising the tool body 126 and coupling 124 about a common axis, as well as allowing securely mounting the body 126 to the coupling 124. It will be appreciated that, in other embodiments (not illustrated), the coupling 124 and tool body 126 are configurable to define a single protrusion 142 and a single channel 152, respectively, which are arranged to allow engaging the body 126 and the coupling 124. In such embodiments, one or more of the coupling 124 and the tool body 126 may define one or more other structures to assist centralising these components 124, 126 about a common axis, such as radially extending ribs or splines extending into the bore 140 of the coupling 124 and dimensioned to slidingly engage a portion of the body 126.

While the illustrated embodiment shows the coupling adaptor 124 defining the radially extending protrusions 142 and the tool body 126 defining the coupling channels 152, it will be appreciated that, in some embodiments (not illustrated), these components are alternatively configured such that the tool body 126 defines one or more radially extending protrusions and the coupling adaptor 124 defines a complementary one or more coupling channels arranged to receive the protrusions. In these embodiments, the coupling channels are typically arranged to open out into the bore 140 such that coupling the, or each, protrusion with the, or each, channel causes mounting the tool body 126 to the coupling adaptor 124.

FIGS. 14 to 17 show the housing assembly 120 includes an end member 158 rotatably mounted at the downhole end 146 of the tool body 126, and a split tube spacer 160 carried by the tool body 126. In this embodiment 120, the end member 158 is configured as an end cap arranged to act as a bumper to protect the downhole end 146 of the body 126 so that, in use, the end member 158 abuts obstacles, such as matter received in the core tube, for example, a drilled core sample. It will be appreciated that the end member 158 may be alternatively shaped, such as to define a sleeve or collar, and arrangeable about or adjacent the downhole end of the body 126. The illustrated split tube spacer 160 is configured as a discontinuous collar 1601. It will also be appreciated the spacer 160 is configurable in other forms to allow spacing split tubes relative to the tool body 126, such as the sleeve embodiment 1602 illustrated below.

The end member 158 is arranged to collide with an obstacle in the path of the tool body 126. A collision typically causes the end member 158 to rotate about the axis 148 of the tool body 126. Decoupling the end member 158 from the body 126 in this way can minimise axial and/or radial forces being transferred to the body 126 and to the adaptor 124 carrying the body 126. The end member 158 can advantageously limit force being transferred to the protrusions 142 of the adaptor 124 positioned within the coupling channels 152 of the tool body 126 and, as a result, reduce instances of the protrusions 142 being plastically deformed or shearing. Also, should the end member 158 become wedged, or otherwise fixed in place, by material received in the core tube, for example, solidified mud, the coupling adaptor 124 and tool body 126 can be freely rotated relative to the static end member 158 to allow disconnecting the coupling adaptor 124 from the core tube without exerting potentially damaging torque through the tool body 126 and the protrusions 142.

The end member 158 is typically formed from a durable, rigid material, such as steel. In some embodiments, the end member 158 is configured to be at least partially formed from a resiliently deformable material, such as silicone, to absorb impact forces. As shown in the illustrated embodiment, the end member 158 may include a conical portion 159 to enhance deflecting matter away from the tool body 126 and/or reduce friction when travelling through a fluid. Furthermore, the conical portion 159 may inhibit damaging a non-flat ended (angular ended) core which abuts the end member 158 when received in the core tube 138 during drilling.

Best shown in FIG. 14, the end member 158 defines a plurality of grooves 162, in this embodiment arranged as axial grooves in an annular array, arranged to allow fluid to flow past the end member 158 when the tool body 126 is mounted to the coupling adaptor 124, such as when the housing assembly 120 is descending into a bore hole causing drilling fluid to flow past the assembly 120 in an uphole direction, to limit resistance to motion of the assembly 120. The grooves 162 are typically dimensioned and arranged to receive the protrusions 142 of the coupling adaptor 124 so that the adaptor 124 can be passed over the end member 158 to arrange the coupling adaptor 124 to be coaxial with the tool body 126. The grooves 162 are typically also dimensioned to receive a plurality of centralising structures 164 extending from the split tube spacer 160 to allow passing the sleeve 160 over the end member 158 to mount the sleeve 160 on the tool body 126.

FIG. 15 illustrates the payload 122 contained in the sealable cavity 150. In this embodiment, the cavity 150 is sealed by a plug 153 releasably mounted across an opening defined by the tool body 126. The plug 153 may include a transparent windowpane, and/or be at least partially formed from a transparent or translucent material, for example, to allow optical communication with the payload 122, such as by conveying infrared signals to and from the payload 122, or allow converting other signals to and from the sealable cavity 150, such as radio frequency signals that require a non-metallic structure, for example, according to the Bluetooth or WiFi protocol. In this embodiment, the payload 122 includes electronic components and at least one battery arranged to power the electronic components. The electronic components are configured for operation as a core orientation device to measure orientation of a core sample received in an associated core tube and still in situ, prior to being broken from bedrock, or immediately after being broken from the bedrock. It will be appreciated that the payload 122 may be alternatively configured to provide a range of other functions.

Figure 16:
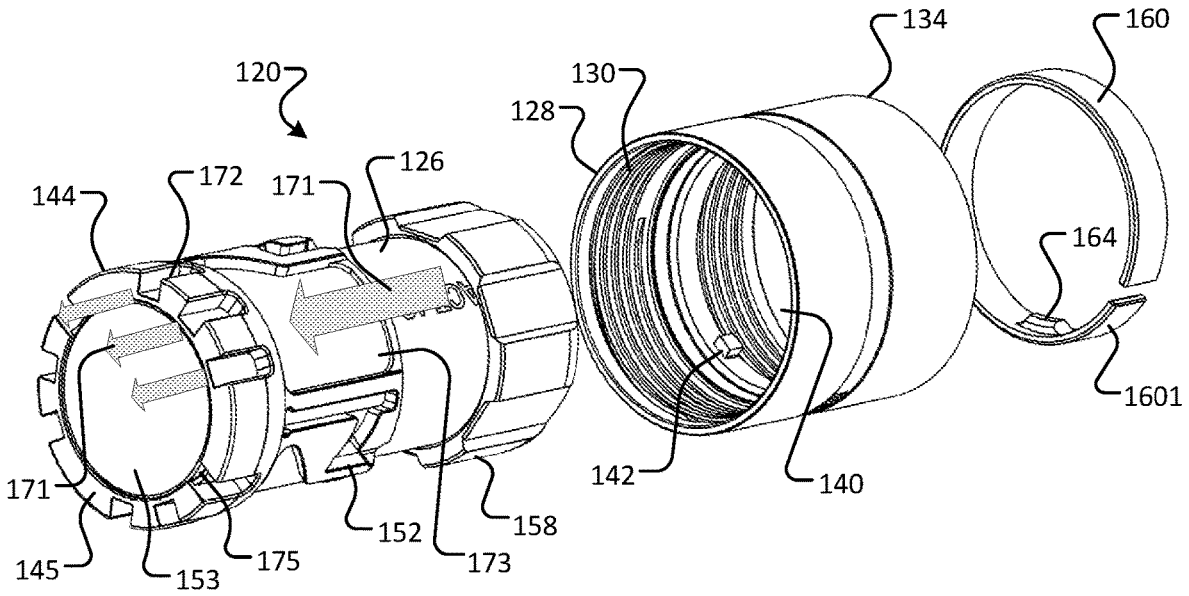

FIG. 16 shows the uphole end 144 of the tool body 126 defines a seating surface 145 arranged to abut the component of a backend assembly 132 when mounted thereto by the coupling adaptor 124. Also shown in FIG. 16, and FIG. 17, the tool body 126 defines a plurality of flow paths, indicated by arrows 171, arranged to allow liquid to flow past the uphole end 144 of the tool body 126 when mounted to the coupling adaptor 124, such as when the body 126 and adaptor 124 are travelling in a downhole direction through a bore hole containing fluid. In this embodiment, the flow paths 171 are defined by an annular array of axially extending grooves 172 extending away from the seating surface 145 and aligned with recessed portions 173 of the body 126 positioned between the coupling channels 152. The grooves 172 are arranged in groups of three, and each group is aligned with one of the recessed portions 173. It will be appreciated that having three grooves 172 in each group is exemplary and that only a single groove 173, or more than three grooves 173, may be provided in each group to convey fluid out of the uphole end 144 of the tool body 126. The arrangement of the recessed portions 173 relative to the grooves 172 allows communicating fluid past the tool body 126 in an uphole direction, from each recessed portion 173 to the associated grooves 172, to exit from the uphole end 144 of the body 126. Also, the configuration of the grooves 172 relative to the seating surface 145, such as the quantity and depth of grooves 173, provides an optimised balance of rate of fluid flow from the uphole end 144 of the tool body 126, and surface area of the seating surface 145 to withstand loads transmitted from the uphole end 144 to the component of a backend assembly 132 during use.

FIG. 16 also shows a cut-out 175 defined by the tool body 126 within one of the grooves 172. A further, like cut-out 175 is defined opposite to the cut-out shown in this figure. The cut-outs 175 are dimensioned to receive a tool (not shown) operable to grip and withdraw the plug 153 from the uphole end 144 of the tool body 126. Arranging the cut-outs 175 to be recessed into the body 126, such as shown within the grooves 173, can minimise exposure of these areas to collisions with other objects or passing fluid, which can reduce instances of the plug 153 being inadvertently removed. Also, the cut-outs 175 may act as vents to allow fluid, such as gas, to be exhausted from the sealable cavity 150, such as may be generated by a faulty battery housed within the cavity 150. For example, should pressurized gas be generated within the sealable cavity 150 during use of the tool body 126, the arrangement of the cut-outs 175 allows such gas to be vented prior to disassembly of the tool body 126 from a downhole assembly, such as by disengaging the coupling adaptor 124 from the component of the backend assembly 132. This can allow relief of potentially unsafe pressures and forces before the tool body 126 is completely removed, which can reduce instances of inadvertent release of the pressurised gas which could cause injury to a user.

Figure 17:
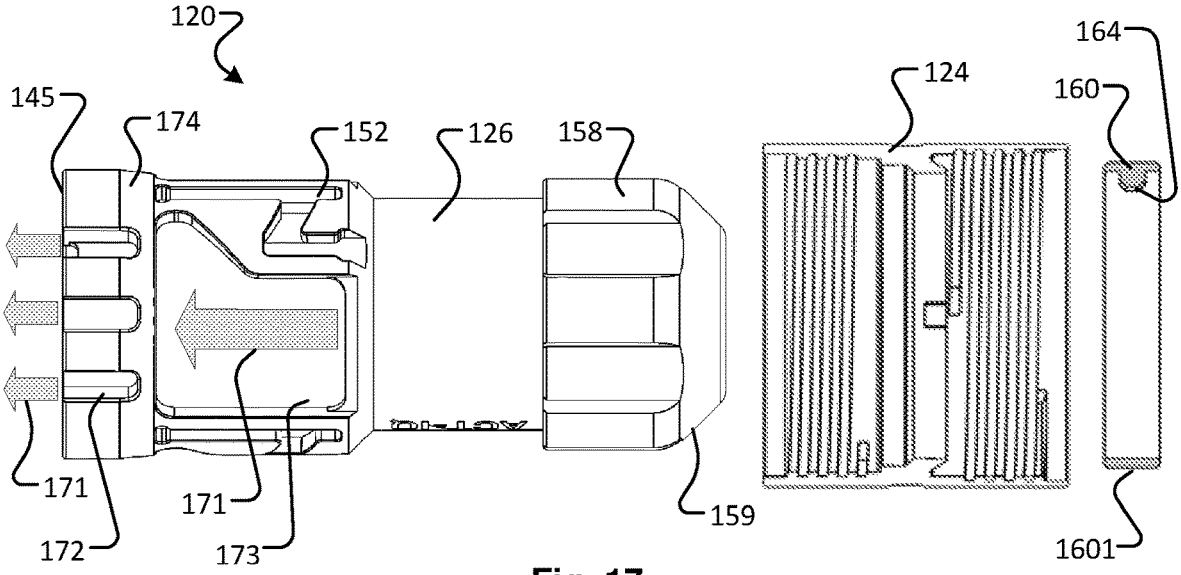

Also shown in FIG. 17, the tool body 126 defines an annular check-valve surface 174 arranged across the downhole end 174 of the grooves 172 and shaped to taper towards the downhole end 146 of the tool body 126. It will be appreciated that, in other embodiments (not illustrated), the flow paths may be defined by alternative geometry of the tool body 126, such as conduits extending axially, or helically, through the body 126, and the check-valve surface 174 may be spaced axially from the flow paths and towards the downhole end 146 of the body 126. The check-valve functionality of the housing assembly 120 is described in greater detail below with reference to FIGS. 27 to 29B.

Figure 18:
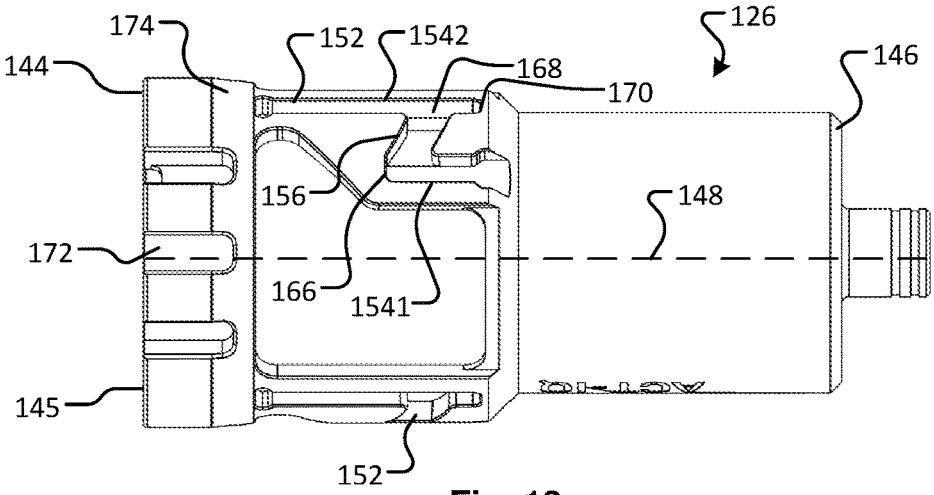
FIGS. 18 and 19 are top and side views, respectively, of a component of the housing assembly shown in FIGS. 14 to 17, being a tool body.
Figure 19:
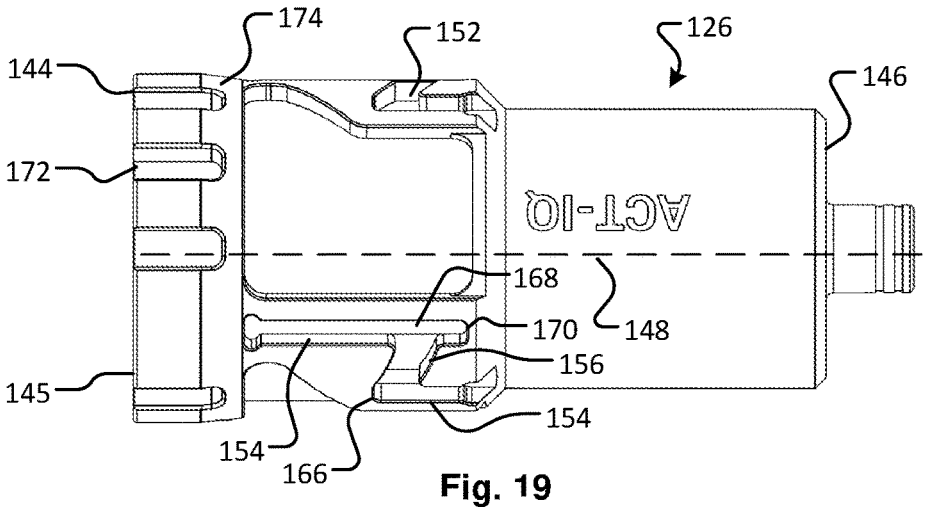
Figure 20A:
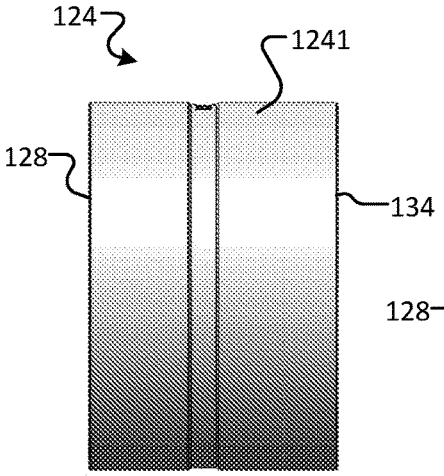
FIGS. 20A to 22C are side, end, and cross-section views of another component of the housing assembly shown in FIGS. 14 to 17, being different embodiments of a coupling adaptor.
Figure 20B:
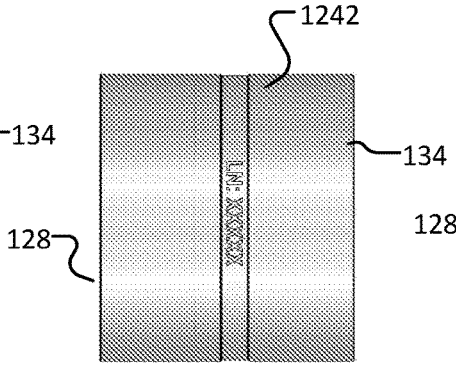
Figure 20C:
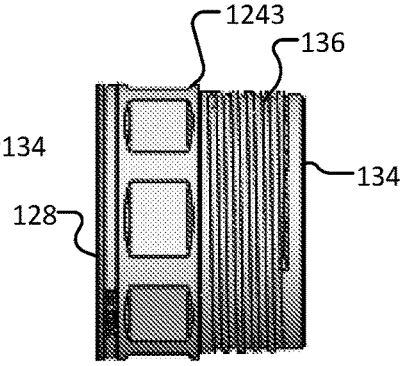

FIGS. 18 and 19 show a top and side view, respectively, of the tool body 126 in isolation to illustrate the geometry of the coupling channels 152. In this illustrated embodiment, each channel 152 has a first axial portion 1541 arranged towards the downhole end 146 of the tool body 126, a second axial portion 1542 arranged towards the uphole end 144 of the body 126, and the joining portion 156 arranged to extend axially and circumferentially from the first axial portion 1541 to the second axial portion 1542 such that the joining portion 156 slopes towards the downhole end 146. The arrangement of the channel portions 154, 156 defines a Z-shaped track along which the protrusion 142 of the coupling adaptor 124 can travel to securely engage the tool body 126. The configuration of the joining portion 156 to slope towards the downhole end 146 can inhibit the protrusion 142 from moving from the second axial portion 1542 along the joining portion 156 and to the first axial portion 1541, particularly when the tool body 126 is positioned to be upright with the downhole end 146 generally facing downwards, such as when being handled when being withdrawn from a bore hole. This structure can usefully inhibit inadvertent disengagement of the tool body 126 and adaptor 124.

Best shown in FIG. 19, each joining portion 156 of the illustrated embodiment extends circumferentially about the axis 148 of the tool body 126 to be at least partially helical. The helical structure can decrease friction between the protrusion 142 and surfaces of the channel 152 to assist coupling the adaptor 124 and the body 126. It will be appreciated that in other embodiments (not illustrated), the joining portion 156 is configurable to define a straight and/or stepped path between the axial portions 154.

The joining portion 156 of each channel 152 is typically configured to extend between a location defined by each axial portion 154, where at least one of the locations is spaced partway along the respective axial portion 154. As shown in FIGS. 18 and 19, in the illustrated embodiment, each joining portion 156 extends from the uphole end 166 of the first axial portion 1541 to a junction location 168 partway along the second axial portion 1542. This arrangement of the joining portion 156 relative to the axial portions 154 means that a downhole section 170 of the second axial portion 1542 extends past the junction location 168. This downhole section 170 can act as a retention pocket to catch and retain the protrusion 142 of the coupling adaptor 124 should the tool body 126 slip through the adaptor 124 when arranged in an upright position, such as being handled when being withdrawn from a bore hole.

FIGS. 20A to 22C show three embodiments 1241, 1242, 1243 of the coupling adaptor 124 from a side, end, and cross-sectional view. The downhole end 134 of the coupling adaptor 124 is typically configured to fit to a specific size/diameter core tube. The first illustrated embodiment 1241 is dimensioned to couple to a standard H or H3 core tube. The second illustrated embodiment 1242 is dimensioned to couple to a standard N or N3 core tube. The third illustrated embodiment 1243 is dimensioned to couple to a standard N2 core tube. It will be appreciated that the dimensions and proportions of the coupling adaptor 124 shown in the figures is exemplary and that the adaptor 124 may be alternatively configured to fit to other standard, or non-standard, size core tubes. In some applications, the housing assembly 120 is provided as a kit comprising the tool body 126 and the three adaptors 1241, 1242, 1243 to allow the assembly 120 to be fitted to one of a range of different, common sizes of core tube. This can usefully limit manufacturing complexity by avoiding production of a range of different downhole tool models configured to fit to specific core tubes, as well as reducing volume and weight of products shipped to users.

Figure 21A:
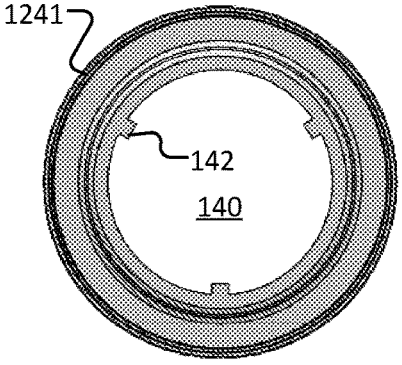
Figure 21B:
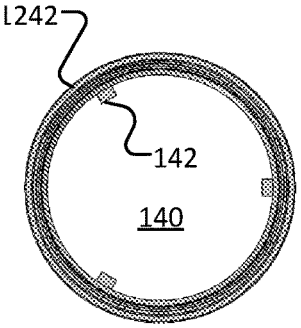
Figure 21C:
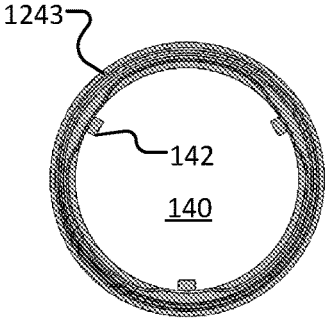

Best shown in FIGS. 21A to 21C, the internal diameter of the bore 140 of each adaptor 1241, 1242, 1243 is dimensioned to be the same to allow receiving and retaining a common tool body 126. Each adaptor 1241, 1242, 1243 defines an annular array of three protrusions 142, in this embodiment configured as pins, spaced evenly about the bore 140 and arranged to be received in the three coupling channels 152 defined by the tool body 126. It will be appreciated that in other embodiments (not illustrated), the coupling adaptor 124 and tool body 126 may be configured to have more, or less, protrusions 142 and channels 152.

Figure 22A:
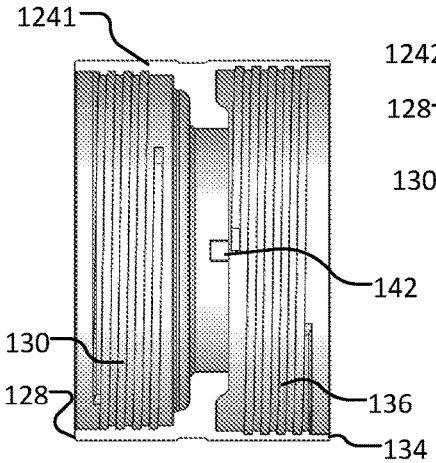
Figure 22B:
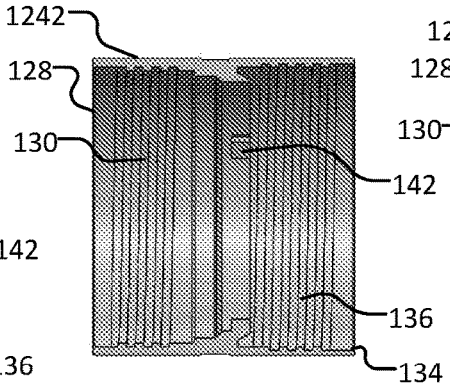
Figure 22C:
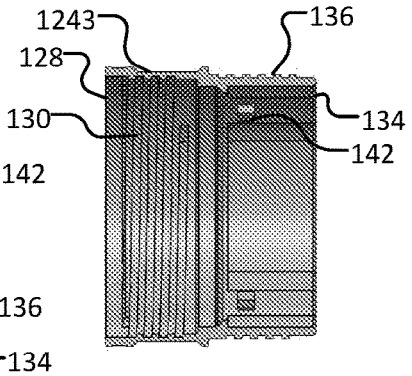

Best shown in FIGS. 22A to 22C, the engagement structures 130, 136 at the ends 128, 134 of each adaptor 1241, 1242, 1243 are non-identical. In the illustrated embodiment, each engagement structure 130, 136 is configured as a thread, and the thread at one end 128 defines at least one of a different pitch, diameter, and thread angle than the thread at the other end 134. The different thread geometries are shown in further detail in FIG. 28. In other embodiments (not illustrated), one or both of the threads is substituted with a bayonet-type fitting. Configuring the engagement structures 130, 136 to be non-identical can usefully inhibit the coupling adaptor 124 being mounted to the core tube 138 and component of a backend assembly 132 in an inverse orientation, which could, for example, cause inadvertent disengagement of the tool body 126 and the adaptor 124.

Figure 23:
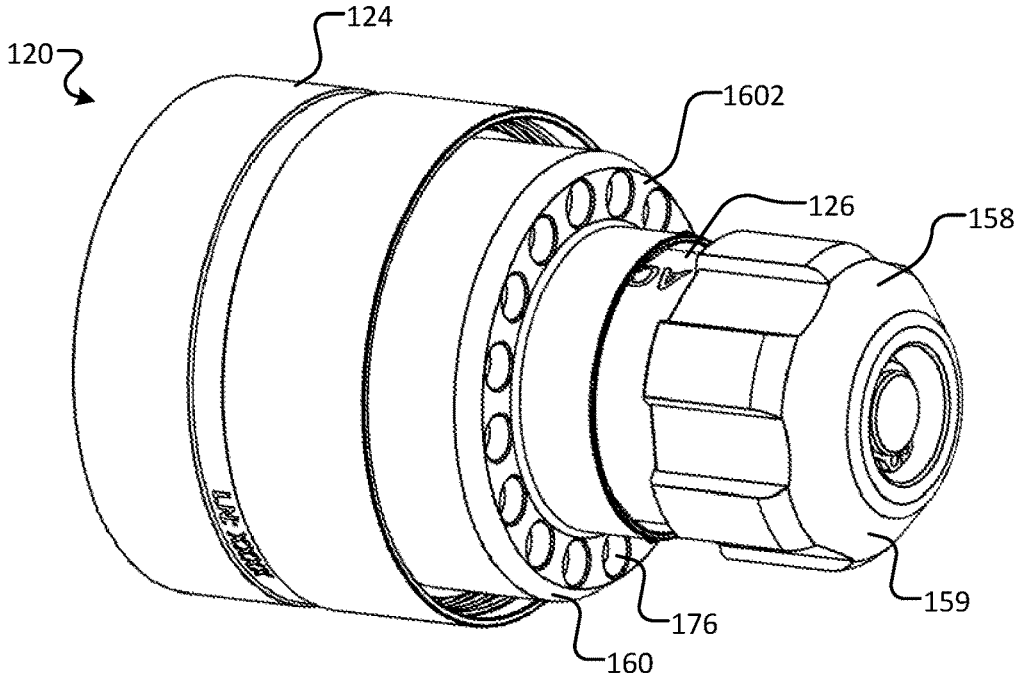
FIG. 23 is a perspective view of an alternative configuration of the housing assembly shown in FIGS. 14 to 17, including an alternative split tube spacer.

FIGS. 15 to 17 show the housing assembly 120 including a first embodiment of the split tube spacer 160, configured as the collar 1601. FIG. 23 shows the housing assembly 120 including a second embodiment of the split tube spacer 160, configured as a sleeve 1602. Each embodiment 1601, 1602 is configured to be mounted on the tool body 126 and arranged, in use, to inhibit at least one of radial and axial movement of split tubes relative to a core tube containing the split tubes. As described in greater detail below, the first split tube spacer 1601 defines an external diameter dimensioned to be received in, and typically sliding engage, a standard N3 size core tube 1381 (FIG. 25) and the second split tube spacer 1602 defines an external diameter dimensioned to be received in, and typically sliding engage, a standard H3 size core tube 1382 (FIG. 26). It will be appreciated that the geometry of the split tube spacer 160 is readily configurable to fit other standard or non-standard size core tubes.

FIG. 23 shows the second split tube spacer 1602 defines flow paths arranged to allow fluid to flow past the tool body 126 in an uphole direction when the split tube spacer 1602 is carried by the tool body 126, and the tool body 126 is mounted to the coupling adaptor 124. In this embodiment 1602, the flow paths are defined by an annular array of apertures 176. In other embodiments (not illustrated), the paths are defined by other recesses, impressions, and/or conduits of the split tube spacer 1602.

Figure 24:
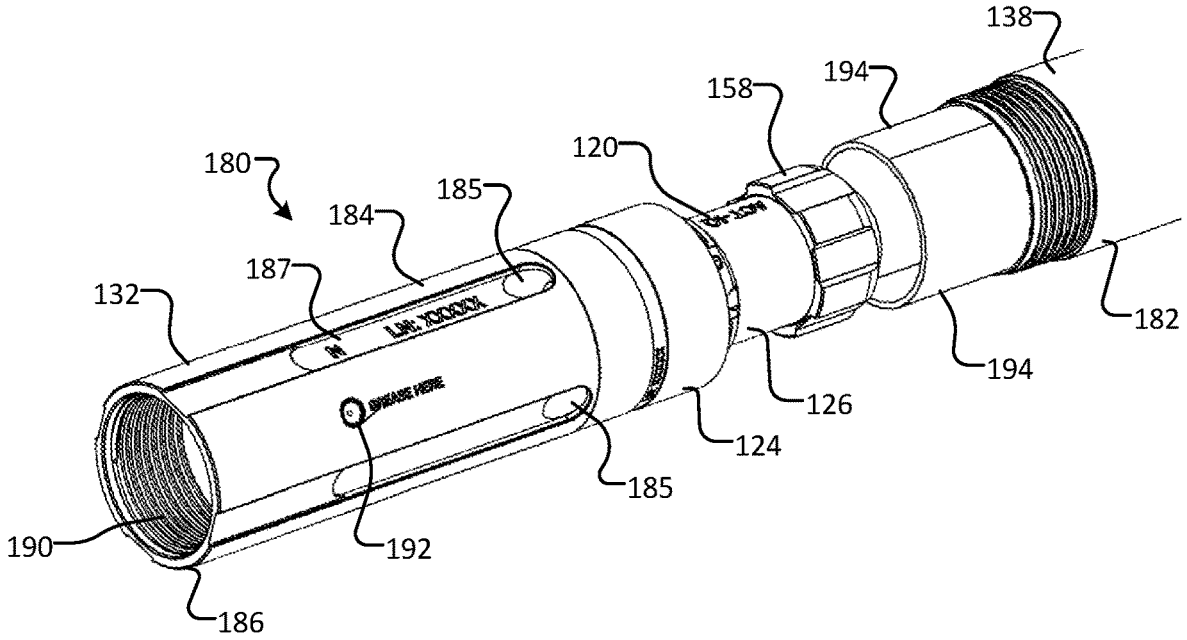
FIG. 24 is an exploded view of a downhole assembly including the housing assembly shown in FIGS. 15 to 17, a core barrel assembly, and a component of a backend assembly.

FIG. 24 shows an exploded view of the housing assembly 120 arranged in a partially disassembled downhole assembly 180 which includes the component of a backend assembly 132, in this illustrated embodiment 180 configured as a grease cap 184, and the core barrel assembly 182. The illustrated grease cap 184 is a non-standard design configured to engage the coupling adaptor 124 and receive the tool body 126 during use. In other embodiments, a standard size and shape grease cap may be employed instead of the illustrated grease cap 184. The core barrel assembly 182 includes the core barrel 138 and a pair of split tubes 194 arranged within the core barrel 138. The coupling adaptor 124 is shown engaged with the grease cap 184 and the tool body mounted to the adaptor 124 to be trapped between the adaptor 124 and the grease cap 184. In other embodiments of the assembly 180 (not illustrated), the coupling adaptor 124 is configurable to engage with an alternative component of the backend assembly.

Figure 25:
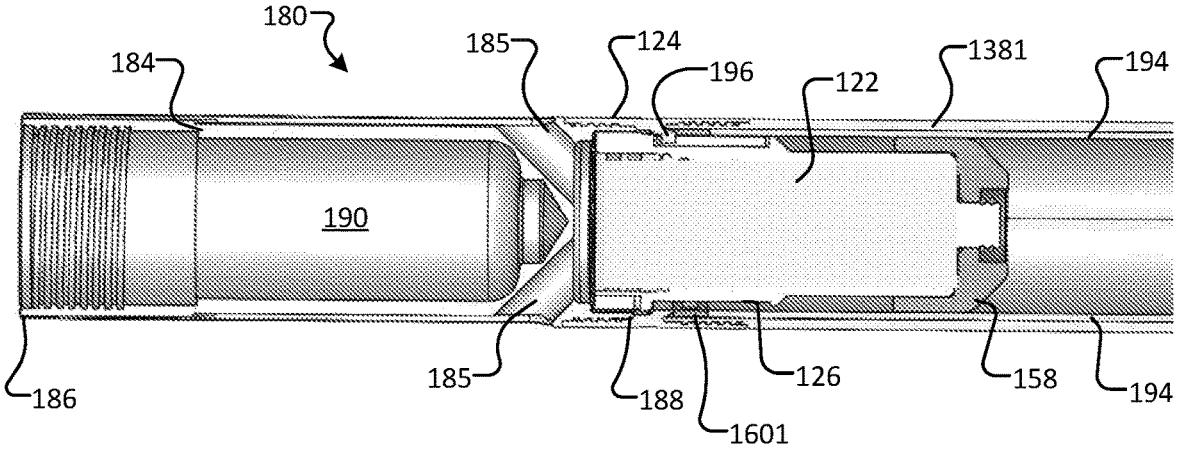
FIGS. 25 and 26 are cross-section views of two different configurations of the downhole assembly shown in FIG. 24.
Figure 26:
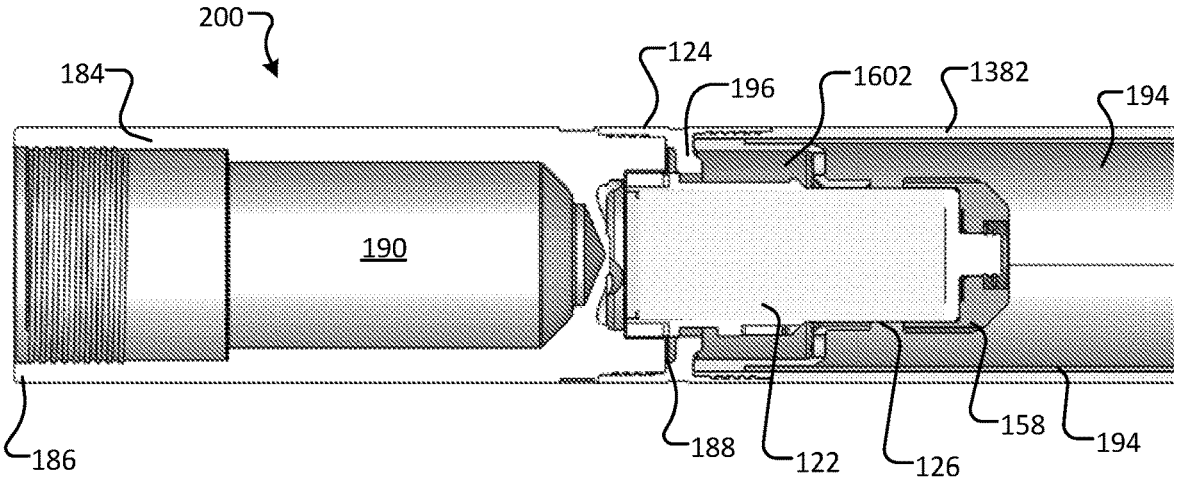

As shown in FIGS. 24 and 25, the grease cap 184 in this embodiment 180 defines an uphole end 186, an opposed downhole end 188, and an internal cavity 190 configured to, in use, contain grease to lubricate other components of the backend assembly 132, such as a spindle shaft. The grease cap 184 also defines a port 192 configured to allow fluid to be introduced into the cavity 190. The port 192 is arranged towards the uphole end 186 of the grease cap 184 to be spaced away from the coupling adaptor 124 and typically includes a one-way valve, such as a grease nipple, to control fluid flow into the cavity 190.

The grease cap 184 also defines at least one water port 185, in this embodiment defining an annular array of four water ports 185, to define a path to communicate fluid from the downhole end 188 to outside of the grease cap 184. An exterior surface of the grease cap 184 defines at least one axially extending track 187, and in this embodiment defines four tracks 187, arranged in an annular array to be complementary to the array of the four water ports 185. Each track 187 is aligned with one of the water ports 185 to allow mounting an accessory, or fitting a tool, on the grease cap 184 so that the accessory or tool is aligned with the water port 185.

FIG. 25 shows a cross-sectional view of the downhole assembly 180 shown in FIG. 24. The core barrel 138 of this assembly 180 is configured as a standard N3 size barrel 1381. The end member 158 and a portion of the tool body 126 is dimensioned to fit snugly within, and typically slidingly engage, the internal walls of the split tubes 194 to inhibit radial movement of the split tubes 194. The split tube spacer 1601 of this assembly 180 is dimensioned to slidingly engage the inside of the core tube 1381 and be arranged to abut the uphole end of each split tube 194 and a flange 196 of the coupling adaptor 124 to inhibit axial movement of the split tubes 194.

FIG. 26 shows a cross-sectional view of an alternative downhole assembly 200 having the same components as the previously described downhole assembly 180 but alternatively dimensioned to include a standard H3 size core barrel 1382. It will be appreciated that common reference numerals indicate common features unless indicated otherwise. The split tube spacer 1602 of this assembly 200 is dimensioned to slidingly engage the inside of each split tube 194 to inhibit radial movement of the split tubes 194, and arranged to abut the uphole end of each split tube 194 and the flange 196 of the coupling adaptor 124 to inhibit axial movement of the split tubes 194.

Figure 27:
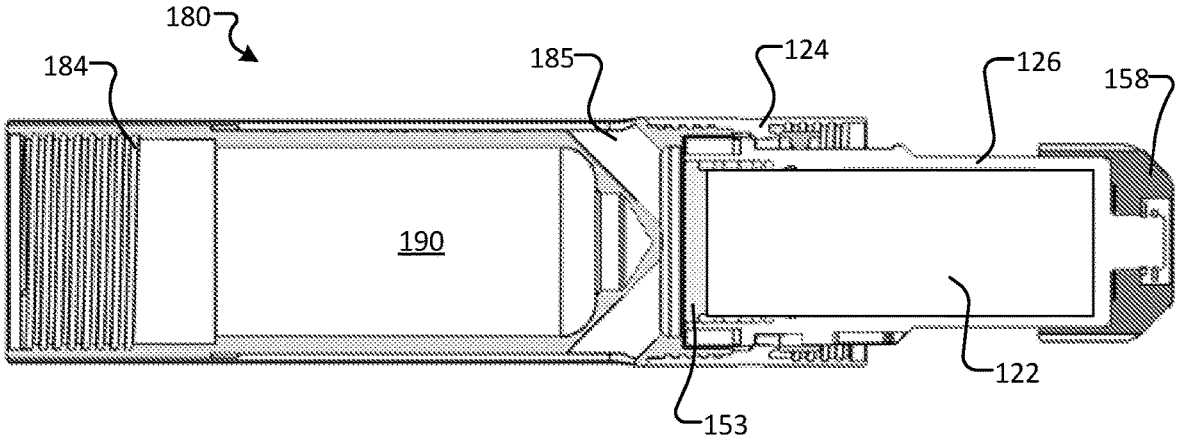
FIG. 27 is a cross-section view of the downhole assembly shown in FIG. 24 with the core barrel assembly hidden.
Figure 28:
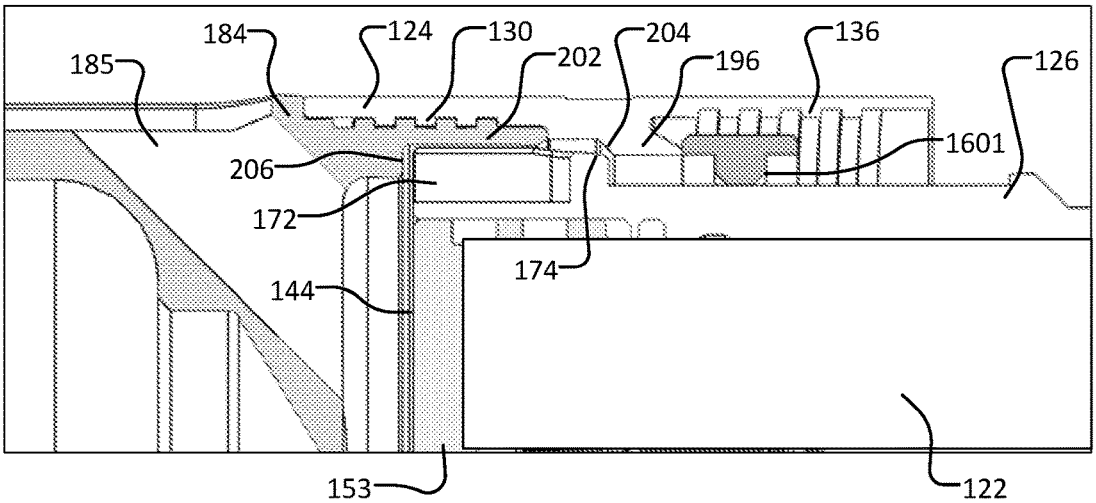

FIG. 27 shows an alternative cross-section view of the downhole assembly 180 shown in FIG. 25, in which the core barrel assembly 182 is hidden. FIGS. 28 to 29B show detailed views of the downhole assembly 180 to illustrate check-valve functionality. It will be appreciated that a check-valve is a one-way valve typically provided in a downhole assembly to inhibit fluid flow in a downhole direction, such as to prevent pressurised fluid from pushing a core sample out of, or being damaged within, the core tube.

In the illustrated embodiment of the assembly 180, the grease cap 184 defines a recess 202 dimensioned to receive, and typically slidingly engage, the uphole end 144 of the tool body 126. The mating relationship of the axial portions 154 of the coupling channels 152 of the tool body 126 and the protrusions 142 of the coupling adaptor 124 allow relative axial displacement of the tool body 126 and the adaptor 124I. The recess 202 of the grease cap 184 is typically dimensioned so that a base surface, in this embodiment defined by a shoulder 206, of the recess 202 limits the relative axial displacement within a defined range. Also, the coupling adaptor 124 defines an annular seat surface 204 arranged to abut the annular check-valve surface 174 of the tool body 126 to limit the opposite extent of the relative axial displacement of body 126 and adaptor 124.

Figure 29A:
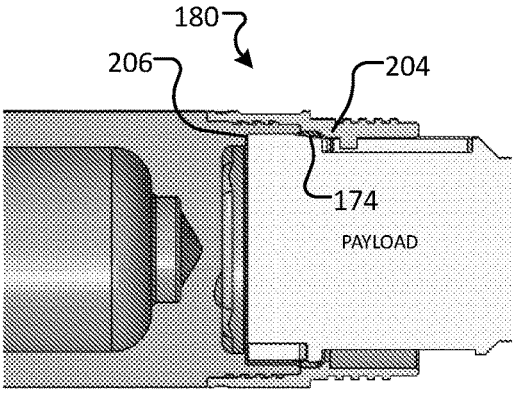
Figure 29B:
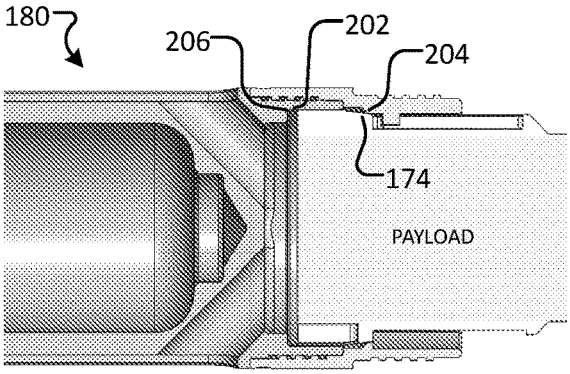

Best shown in FIG. 29A, displacing the tool body 126 relative to the coupling adaptor 124 in an uphole direction causes the check-valve surface 174 to be spaced away from the seat surface 204 until the uphole end 144 of the tool body 126 collides with the shoulder 206 of the recess 202. This defines a path for fluid to flow through the bore 140 of the adaptor 124 in an uphole direction and past the tool body 126. This typically allows the fluid to flow through the grooves 172 to exit at the uphole end 144 of the body 126. The tool body 126 may be urged in the uphole direction during use, as illustrated in FIG. 29A, due to environmental forces, such as, for example, when the assembly 180 is descending down a bore hole and through drilling fluid contained in the bore hole.

Best shown in FIG. 29B, displacing the tool body 126 relative to the coupling adaptor 124 in a downhole direction causes the check-valve surface 174 to press against the seat surface 204 to inhibit fluid flowing past the tool body 126 and through the bore 140 of the adaptor 124 in a downhole direction, to effectively seal the bore 140. The tool body 126 may be urged in the downhole direction during use, as illustrated in FIG. 29B, due to environmental forces, such as, for example, when the downhole assembly 180 is located down a bore hole and exposed to drilling fluid pumped into the bore hole, or as the assembly 180 is raised towards the surface.

The downhole tool assembly 10 may be used when extracting a core from bedrock and measuring one or more parameters relating to the core. Use in this application may involve: arranging the at least one sleeve 20 about the tool 18 and within the core barrel assembly 12; operating a drilling rig to drill the core from the bedrock and be received in the split tubes 16, concurrently with operating the tool 18 to measure the one or more parameters; retrieving the core barrel assembly 12 and downhole tool assembly 10 to the surface; operating the tool 18 to obtain measured data; mounting a plug within the core tube 14 to seal the bore; and directing fluid against the plug to cause the core and split tubes 16 to be expelled from the core tube 14.

Assembling the housing assembly 120 typically involves: inserting the tool body 126, carrying the payload 122, into the uphole end 128 of the coupling adaptor 124 and within the bore 140 defined by the coupling adaptor 124 to cause inserting the plurality of pins 142 extending from the coupling adaptor 124 into the complementary plurality of coupling channels 152 defined by the tool body 126; axially displacing the tool body 126 relative to the adaptor 124 to slide the pins 142 along a first portion 154 of the channels; rotating the tool body 126 relative to the adaptor 124 to slide the pins 142 along a second, joining portion 156 of the channels 152; and axially displacing the tool body 126 relative to the adaptor 142 to slide the pins 142 along a third portion 154 of the channels 152 to cause the tool body 126 to be mounted to the coupling adaptor 124. Where split tubes will be housed within the core tube 138, assembly of the housing assembly 120 may also include manually passing the split tube spacer 160 over the end member 158 of the tool body 126 to slidingly engage the sleeve 160 with the body 126. This process is typically achieved by manual effort of a user using their hands to assemble the assembly 120, without requiring any specific tools or a jig. The housing assembly 120 is now ready for fitting to a downhole assembly 180, 200.

Assembling the downhole assembly 180, 200 involves: engaging the uphole end 128 of the coupling adaptor 124 with a component of the backend assembly 132, such as the grease cap 184; and engaging the downhole end 134 of the coupling adaptor 124 with the core tube 138. Engaging the coupling adaptor 124 with the component of the backend assembly 132 traps the tool body 126 between the coupling adaptor 124 and the backend assembly 132. Coupling the adaptor 124 to the backend assembly 132 also typically slidingly engages the uphole end 144 of the tool body 126 with the recess 202 defined by the component of the backend assembly 132. The downhole assembly 180, 200 is now ready for deployment into a bore hole.

Where the assembly 10 is configured as the first embodiment 40 described above, use may also involve, before mounting the plug, removing the sleeves 42, 44 and the tool 18 from the core barrel assembly 12. The plug, which is typically configured as the ejection piston assembly 52, is then mounted to the core tube 14 to allow pumping fluid against piston assembly 52 and cause the core and split tubes 16 to be expelled from the core tube 14.

Where the assembly 10 is configured as the second embodiment 60 described above, use may also involve, before mounting the plug, removing the tool 18 from the piston 72. The plug, which is typically configured as the plug assembly 100, is then engaged with the piston 72 by as engaging the projections 106 of the plug assembly 100 with the annular groove 92 of the piston 72. Fluid is then pumped against the plug assembly 100 to urge the core and split tubes out of the core tube 14.

The downhole tool assembly 10 allows mounting the downhole tool 18 coaxially to the bore of the core barrel assembly 12 while inhibiting radial movement of the split tubes 16 of the assembly 12 relative to the bore. This can reduce instances of, or prevent, the split tubes 16 overlapping each other. Avoiding overlapping can be advantageous, as this can inhibit receiving a core within the split tubes 16 or otherwise cause mechanical issues downhole, which can be complex and expensive to rectify.

The arrangement of the downhole tool assembly 10 relative to the core barrel assembly 12 allows positioning the tool 18 at least partially, and typically substantially, within the core barrel assembly 12. This can reduce the overall length of a downhole assembly and/or avoid requiring any extension tube.

The configuration of the sleeves 20 allows arranging the downhole tool 18 coaxially with the core tube 14 and can enhance fluid flow along the bore of the core tube 14 and past the sleeve(s) 20, for example, when the core tube 14, connected to the sleeve(s) 20, is descending into a borehole. This can reduce descent time periods, which can enhance core extraction operational efficiency and reduce costs.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A housing assembly for a downhole tool, the housing assembly including:

a coupling adaptor having an uphole end defining a first engagement structure for engaging a component of a backend assembly, and an opposed downhole end defining a second engagement structure for engaging a core tube, the coupling adaptor further defining a bore extending between the ends and a plurality of protrusions extending radially into the bore; and a tool body having an uphole end, an opposed downhole end and a longitudinal axis extending between the ends, the tool body including a sealable cavity dimensioned to receive a payload, and defining a plurality of coupling channels, each coupling channel dimensioned to receive one of the protrusions, and each coupling channel defining a pair of axial channel portions extending parallel to the axis and spaced apart about the axis, and a joining channel portion extending circumferentially about the axis to join between the axial channel portions, whereby arranging the tool body within the bore of the coupling adaptor, and sliding each of the protrusions along each portion of one of the coupling channels, mounts the tool body to the coupling adaptor.

2. The housing assembly of claim 1, wherein each channel defines a first axial channel portion arranged towards the downhole end, and a second axial channel portion arranged towards the uphole end, and the joining channel portion is arranged to extend axially and circumferentially from the first axial channel portion to the second axial channel portion such that the joining channel portion is defined to slope towards the downhole end.

3. The housing assembly of claim 2, wherein each joining channel portion is shaped to be at least partly helical about the axis, and wherein the joining channel portion extends between a location defined by each axial channel portion, wherein at least one of the locations is spaced partway along the respective axial channel portion.

4. The housing assembly of claim 1, wherein the coupling adaptor includes three or more of the protrusions arranged in an annular array, and the tool body defines a complementary three or more of the coupling channels arranged in annular array.

5. The housing assembly of claim 4, wherein the array of protrusions extend from an annular flange arranged to extend into the bore.

6. The housing assembly of claim 1, wherein the tool body defines a plurality of axially extending flow paths arranged to allow liquid to flow towards and past the uphole end of the tool body when mounted to the coupling adaptor, and the tool body further defines an annular check-valve surface arranged at, or spaced axially from, a downhole end of the flow paths, the check-valve surface shaped to taper towards the downhole end of the tool body.

7. The housing assembly of claim 6, wherein the coupling adaptor defines an annular seat surface shaped to abut the check-valve surface of the tool body such that arranging the check-valve surface against the seat surface inhibits liquid flowing through the bore and out of the downhole end of the coupling.

8. The housing assembly of claim 1, including an end member rotatably mounted at the downhole end of the tool body, wherein the end member defines a conical portion arranged to taper away from the downhole end of the tool body, and an annular array of grooves arranged to allow liquid to flow past the end member when the tool body is mounted to the coupling adaptor.

9. The housing assembly of claim 8, wherein the annular array of grooves are arranged to receive the plurality of protrusions of the coupling adaptor, such that passing the protrusions through the grooves causes the coupling adaptor to be coaxial to the tool body.

10. The housing assembly of claim 1, wherein each of the first engagement structure and the second engagement structure include a thread, and wherein the thread of the first engagement structure defines at least one of a different pitch, diameter, and thread angle than the thread of the second engagement structure.

11. The housing assembly of claim 10, wherein the second engagement structure is configured to engage a standard size core tube.

12. The housing assembly of claim 1, further including a split tube spacer defining an internal diameter dimensioned to slidingly engage a portion of the tool body and an external profile shaped to at least one of: slidingly engage an inside of each of a pair of split tubes; and abut an uphole end of each of a pair of split tubes, such that mounting the split tube spacer to the tool body, in use, inhibits at least one of axial and radial movement of the split tubes relative to a core tube.

13. The housing assembly of claim 12, wherein the split tube spacer defines one or more structures arranged to allow liquid to flow past the tool body in an uphole direction when the split tube spacer is carried by the tool body and the tool body is mounted to the coupling adaptor.

14. The housing assembly of claim 1, wherein the payload includes electronic components and at least one battery.

15. The housing assembly of claim 14, wherein the electronic components are configured for measuring orientation of a core sample in situ, prior to being broken from bedrock.

16. The housing assembly of claim 1, further including a plug slidably mounted to the tool body to seal the sealable cavity, and the tool body defines one or more vent recesses arranged at, or adjacent, the uphole end to allow venting of fluid from within the sealable cavity when the plug is partially removed from the tool body.

17. A downhole assembly including:

the housing assembly of claim 1; and a backend assembly having a component configured to engage the first engagement structure of the coupling adaptor, the component defining a recess dimensioned to slidingly engage the uphole end of the tool body.

18. The downhole assembly of claim 17, wherein the component is configured as a grease cap defining an uphole end and an opposed downhole end, and a cavity configured to, in use, contain grease, and further defines a port configured to allow fluid to be introduced into the cavity, the port arranged towards the uphole end of the grease cap.

19. The downhole assembly of claim 18, wherein the grease cap defines at least one water port, and an exterior surface of the grease cap defines at least one axially extending track aligned with the at least one water port.

20. A housing assembly for a downhole tool, the housing assembly including:

a coupling adaptor having an uphole end defining a first engagement structure for engaging a component of a backend assembly, and an opposed downhole end defining a second engagement structure for engaging a core tube, the coupling adaptor further defining a bore extending between the ends and a protrusion extending radially into the bore; and a tool body having an uphole end, an opposed downhole end and a longitudinal axis extending between the ends, the tool body including a sealable cavity dimensioned to receive a payload, and defining a coupling channel dimensioned to receive the protrusion, the coupling channel comprising a pair of axial channel portions extending parallel to the axis and spaced apart about the axis, and a joining channel portion extending circumferentially about the axis to join the axial channel portions, whereby arranging the tool body within the bore of the coupling adaptor, and sliding the protrusion along each portion of the coupling channel, mounts the tool body to the coupling adaptor.

21. A method of assembling a housing assembly for a downhole tool, the method including:

arranging a tool body, carrying a payload, within a bore defined by a coupling adaptor, the tool body having a longitudinal axis and defining a plurality of coupling channels, each coupling channel dimensioned to receive one of a plurality of protrusions defined by the coupling adaptor and extending radially into the bore, and each coupling channel defining a pair of axial channel portions extending parallel to the axis and spaced apart about the axis, and a joining channel portion extending circumferentially about the axis to join between the axial channel portions, such that arranging the tool body within the bore causes at least one of the plurality of protrusions extending from the coupling adaptor to insert into a complementary at least one coupling channel defined by the tool body;

axially displacing the tool body relative to the adaptor to slide the at least one protrusion along one of the pair of axial channel portions;

rotating the tool body relative to the adaptor to slide the at least one protrusion along the joining channel portion; and axially displacing the tool body relative to the adaptor to slide the at least one protrusion along the other one of the pair of axial channel portions to cause the tool body to be mounted to the coupling adaptor.

22. A kit for housing a downhole tool, the kit including:

a plurality of coupling adaptors, each coupling adaptor having an uphole end defining a first engagement structure configured to engage a component of a backend assembly, and an opposed downhole end defining a second engagement structure configured to engage a specific core tube, each coupling adaptor further defining a bore extending between the ends and at least one protrusion extending radially into the bore; and a tool body having an uphole end, an opposed downhole end and a longitudinal axis extending between the ends, the tool body including a sealable cavity dimensioned to receive a payload, and defining a complementary at least one coupling channel, the, at least one coupling channel dimensioned to receive the at least one protrusion, the, or each coupling channel defining a pair of axial channel portions extending parallel to the axis and spaced apart about the axis, and a joining channel portion extending circumferentially about the axis to join the axial channel portions, whereby arranging the tool body within the bore of the coupling adaptor, and sliding the at least one protrusion along each portion of the at least one coupling channel, mounts the tool body to the coupling adaptor, and wherein each of the coupling adaptors are configured to engage a different core tube to allow mounting the tool body to a range of alternatively dimensioned core tubes.

23. The kit of claim 22, wherein the kit further comprises the component of the backend assembly, and wherein said component is a grease cap.

* * * * *